US006457535B1

(12) United States Patent
Tanaka

(10) Patent No.: US 6,457,535 B1
(45) Date of Patent: Oct. 1, 2002

(54) IMPACT ROTARY TOOL

(75) Inventor: Naotake Tanaka, Shiga (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/560,571

(22) Filed: Apr. 28, 2000

(30) Foreign Application Priority Data

Apr. 30, 1999 (JP) ..... 11-124928

(51) Int. Cl.[7] ..... E02D 7/06

(52) U.S. Cl. ..... 173/48; 173/47; 173/178; 173/216

(58) Field of Search ..... 173/97, 48, 93, 173/93.6, 96, 149, 218, 216, 220, 221, 178

(56) References Cited

U.S. PATENT DOCUMENTS 3,403,738 A * 10/1968 Burkhart et al. ..... 173/105
3,777,825 A * 12/1973 Reinhold ..... 173/109
5,056,607 A * 10/1991 Sanders ..... 173/48
5,563,482 A * 10/1996 Shaw et al. ..... 318/272
5,673,758 A * 10/1997 Sasaki et al. ..... 173/178

FOREIGN PATENT DOCUMENTS

JP 7-040258 2/1995

* cited by examiner

*Primary Examiner*—Scott A. Smith
*Assistant Examiner*—Nathaniel Chukwurah
(74) *Attorney, Agent, or Firm*—Oblon, Spivak, McClelland, Maier & Neustadt, P.C.

(57) ABSTRACT

An impact rotary tool includes an output shaft having an anvil at an end portion thereof, a hammer having a projecting portion applying an impact force to the anvil under a predetermined condition, a driving shaft connected to the hammer through a cam mechanism, and a changeover mechanism for changing the connection between the driving shaft and the output shaft. The mechanism is arranged along with a common axis defined by the driving shaft and the output shaft. The changeover mechanism includes a connecting member accommodated into the driving shaft in a first condition, and connecting the driving shaft and the output shaft in a second condition.

19 Claims, 19 Drawing Sheets

IMPACT ROTARY TOOL

BACKGROUND OF THE INVENTION

1. Field of Invention

The present invention relates to an improvement in a rotary tool such as an impact wrench and an impact driver for use in an operation to tighten a bolt, a nut and a screw.

2. Related Art

An impact rotary tool such as an impact wrench and an impact driver is a tool structured such that a hammer, which is connected through a cam to a drive shaft disposed so as to be rotationally driven, is energized by a spring to the side of an anvil disposed on an output shaft, and the anvil is engaged with the hammer in an impact manner by the cam and spring to thereby produce a rotational force; and, when it is used in an operation for tightening a bolt, a nut, and a screw, the impact rotary tool produces only a small reactive force which is given to the hand of an operator, and thus the impact rotary tool provides a high efficiency in the tightening operation. However, since the impact rotary tool produces an intermittent impact rotational force, in the case of making a hole in metal (in case where it is used as a drill), a drill bit can chip or the rotating number of the impact rotary tool can decrease, which makes it impossible to make a hole.

In view of this, there is proposed an impact rotary tool structured such that the motion of the hammer in the axial direction thereof is limited to thereby unable to provide an impact operation, that is, the hammer is prevented from parting away from the anvil to thereby be able to cope with a drill operation. However, in this case, in case where the restriction of the axial motion of the hammer is carried out by an external operation portion, there is still left a problem that the axial motion of the hammer by the spring is given to the-external operation portion to thereby lower the power transmission efficiency.

Here, in Japanese Patent Publication Hei. 7-40258, there is disclosed an impact rotary tool structured such that an anvil supported rotatable with respect to a drive shaft is connected to the drive shaft to thereby disable the anvil from rotating with respect to the drive shaft, that is, connect the anvil directly with the drive shaft, so as to be able to provide an operation which is different from the impact operation. In the case of this structure, there is eliminated the need to move the axial positions of the hammer and anvil against a spring used to energize the hammer, which makes it possible to switch a drill operation and an impact operation over to each other without lowering the power transmission efficiency.

In the impact rotary tool disclosed in the above-cited publication, however, to disable the anvil, which is supported rotatable with respect to the drive shaft, from rotating with respect to the drive shaft is carried out by inserting a connecting member into both of the drive shaft and anvil from outside. This makes it necessary for an operator to carry the connecting member and, in case where the connecting member is not available, it is not possible to switch the present impact rotary tool over to the drill operation.

In the above-cited publication, there is also disclosed an impact rotary tool which can be switched between the impact operation and the drill operation by moving an anvil in the axial direction thereof by means of an external operation. In this case, however, not only there is required a structure capable of moving the anvil in the axial direction thereof but also it is necessary to secure a space for the axial movement of the anvil, which increases the size of the drive portion of the impact rotary tool. Therefore, it is difficult to reduce the size of the impact rotary tool, and it is also difficult to use of the impact rotary tool in common with other tools which do not have the above-mentioned switching function.

Also, because the engagement between the drive shaft and anvil is impossible if the engagement portion of the drive shaft and the engagement portion of the anvil do not correspond to each other, it is necessary to match the positions of these two parts to each other.

Further, when the hammer stops in a state where the projecting portion of the hammer and anvil are superimposed on each other, in case where the drive shaft is connected to the anvil at this position, the load of the spring applied to the hammer acts as a rotation load to thereby lower the power transmission efficiency.

In addition, although the present impact rotary tool is able to make a hole as a drill, it does not employ a torque clutch or a speed change mechanism which are employed in an electric driver, because the employment of them incurs a further increase in the size of the impact rotary tool. This raises another problem in the impact rotary tool that tightening with a proper torque is impossible and a rotary torque is short, thereby being unable to carry out a satisfactory tightening operation.

SUMMARY OF THE INVENTION

The present invention aims at eliminating the above-mentioned drawbacks found in the conventional impact rotary tools. Accordingly, it is a main object of the invention to provide an impact rotary tool which can be simply switched between an impact operation and a drill operation and can prevent mechanisms necessary for execution of such simple switching from incurring an increase in the size of the impact rotary tool. Also, it is another object of the invention to provide an impact rotary tool which not only can realize a smooth switching operation but also is capable of employing a torque clutch and speed change means as well.

In attaining the above objects, according to the invention, there is provided an impact rotary tool, comprising:

an impact mechanism including a spring for energizing a hammer connected through a cam to a drive shaft toward an anvil disposed on an output shaft, the impact mechanism being structured such that the anvil is engaged with the hammer in an impact manner using the cam and spring to thereby be able to generate a rotation force; and, switching means for switching the anvil supported relatively rotatable with respect to the drive shaft into a state in which the anvil is disabled from proportionally rotating with respect to the drive shaft, wherein, in both of the drive shaft and anvil supported relatively rotatable with respect to the drive shaft, there are respectively formed engagement portions engageable with a connecting member, the connecting member is structured such that it can be operated in linking with the operation of an external operation inputting operation portion formed so as to be operated from outside, and the connecting member is used as the switching means.

According to the invention, in case where the external operation inputting operation portion is operated, the connecting member changes the state of the relative rotation relation between the drive shaft and anvil to thereby be able to switch the impact operation and drilling operation over to each other.

In this case, preferably, the engagement portion of the drive shaft and the engagement portion of the anvil may be situated on the same axis, and the connecting member can be switched between a state in which the connecting member is engaged with both of the two engagement portions of the drive shaft and the anvil at the same time and a state in which the connecting member is not engaged with at least one of the two engagement portions. And, in case where an intermediate transmission member interposed between a motor and said drive shaft is supported in such a manner that it can be freely moved in the axial direction thereof, and an operation member and the connecting member are connected to the present intermediate transmission member which is rotationally connected to the drive shaft through key connection, or in case where the intermediate transmission member and connecting member are connected to each other by a switching pin which extends through the drive shaft in the axial direction thereof and can be freely moved in the axial direction thereof with respect to the drive shaft, there can be obtained a special advantage that the impact rotary tool can be made compact.

And, preferably, the connecting member may be connected in such a manner that it can be freely rotated with respect to the switching pin and is disabled from moving in the axial direction thereof. Also, preferably, the switching pin includes a shaft which is supported at the axis position thereof by a member fixed to the motor.

Also, preferably, a torque clutch may be disposed in a power transmission route extending from a motor for driving to an output shaft. In this case, preferably, the present torque clutch may include an adjust screw which is supported threadedly movable back and forth for setting a sliding-start torque, and the adjust screw may be structured such that it can be engaged in an axially slidable manner with a drive portion cover disposed so as to be freely rotatable around its own axis with respect to a housing and the axial movement of the adjust screw can be achieved by the rotational operation of the drive portion cover. This can facilitate an operation to set a sliding-start torque. Also, in case where the adjust screw includes on the outer periphery thereof a seal member which can be slidingly contacted with the drive portion cover or the inner surface of the housing, grease filled into the cam portions of the drive shaft and hammer can be prevented from flowing out therefrom.

Preferably, in a power transmission route extending from a motor for driving to an output shaft, there can be disposed speed change means. In this case, preferably, the speed change means may be structured such that it changes the speed of power transmission in linking with the switching means and, when the drive shaft and anvil are connected by the connecting member in such a manner that they are disabled from rotating with respect to each other, executes the speed change prior to the connection between the drive shaft and anvil.

Also, in a power transmission route extending from a motor for driving to an output shaft, there may be disposed not only a torque clutch capable of switching its own operation in linking with the operation of the switching operation but also speed change means. In this case, preferably, when the anvil is held so as to be rotatable with respect to the drive shaft, the torque clutch may be removed from the power transmission route and the speed change means may provide a small speed change ratio, and, when the anvil is held so as to be disabled from rotating with respect to the drive shaft, the torque clutch may be disposed in the power transmission route and the speed change means may provide a large speed change ratio.

And, preferably, the connecting member may be structured such that it connects the drive shaft and anvil to each other only at the position where the hammer does not run onto the anvil, or such that it connects the drive shaft and anvil to each other in a state where the hammer is in contact with the anvil in a rotation transmission allowable manner.

Also, preferably, the operation allowable clearance of the connecting member in the axial direction thereof in a state where the drive shaft and anvil are separated from each other may be set larger than the thrust play of the drive shaft.

And, preferably, the operation portion and connecting member may be connected to each other through an elastic member.

DETAILED DESCRIPTION OF THE PREFERRED EMBODIMENTS

First Embodiment

Figure 1:
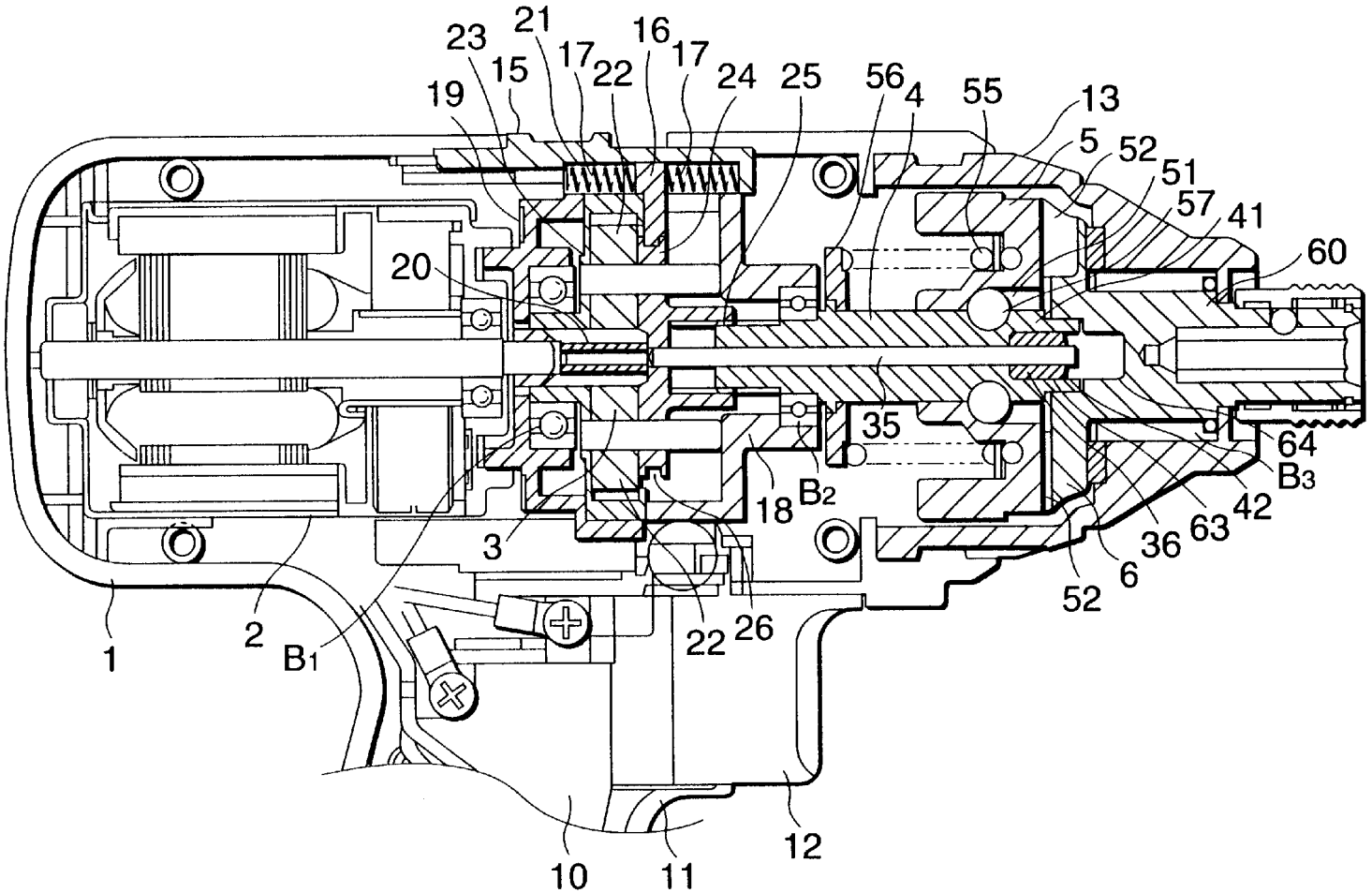
FIG. 1 is a longitudinal section view of a first embodiment of an impact rotary tool according to the invention.
Figure 2:
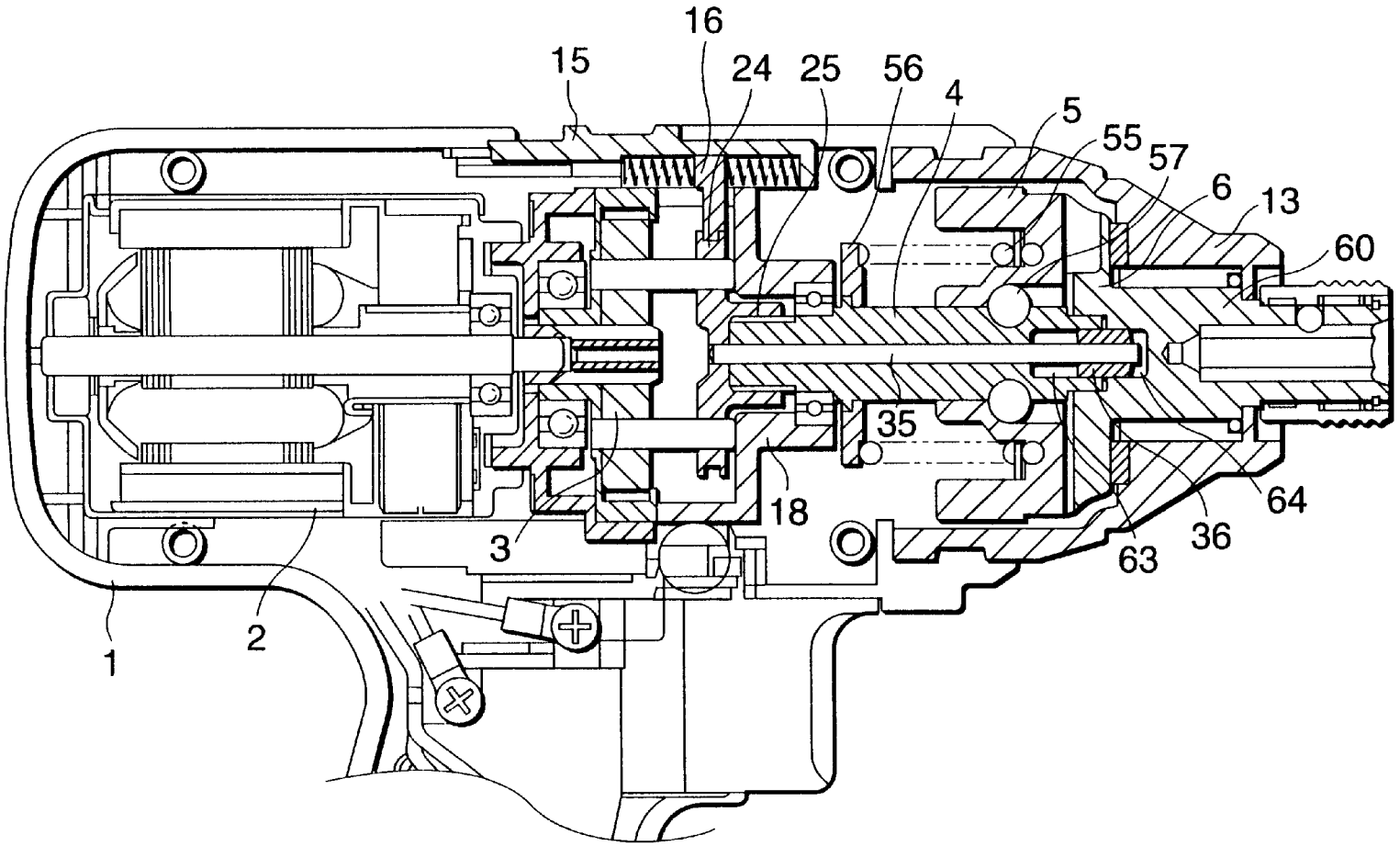
FIG. 2 is a longitudinal section view of the first embodiment, showing a state thereof in which the operation thereof is switched.

Now, description will be given below in detail of a first embodiment of an impact rotary tool according to the invention. An impact rotary tool shown in FIGS. 1 and 2 is a battery-operated portable-type impact rotary tool in which the output of a motor 2 is reduced by a planetary mechanism 3 and is transmitted to a drive shaft 4, and an anvil 6 formed integral with an output shaft 60 is struck with a hammer 5 mounted on the drive shaft 4 to thereby be able to provide an impact output; and, a battery (not shown) used as the power source of the impact rotary tool is to be mounted on the lower end of a grip portion 10 formed so as to be extended from a housing 1 and, in the root portion of the grip portion 10, there is disposed a switch 11. In FIGS. 1 and 2, reference character 12 designates a trigger switch handle.

An impact mechanism includes the drive shaft 4, hammer 5, anvil 6, a spring 55 for energizing the hammer 5 to the anvil 6 side, and a spring receiver 56 and, a steel ball 57 is engaged with a groove 41 disposed on the outer periphery of the drive shaft 4 and also with a groove 51 disposed on the inner peripheral surface of the hammer 5 to define a cam mechanism. When the drive shaft 4 rotates, the hammer 5, which is formed so as to rotate together with the drive shaft 2 and the projecting portion 52 thereof is engaged with the anvil 6 due to the energization of the spring 55, rotates the anvil 6 and output shaft 60; and, in case where a torque on the load side increases, the hammer 5 rotates with respect to the drive shaft 4 and moves back in accordance with the lead of the cam against the spring 55. And, in case where the projecting portion 52 of the hammer 5 goes beyond the anvil 6, the hammer 5 moves forward in accordance with the lead of the cam due to the energization of the spring 55, so that the hammer 5 applies a striking impact to the anvil 6 in the rotation direction using the projecting portion 52 thereof.

Between the motor 2 and drive shaft 4, as described above, there is interposed a reduction gear consisting of the planetary mechanism 3. In this planetary mechanism 3, a planetary gear 22, which is formed so as to mesh with a sun gear 20 fixed to the output shaft of the motor 2 and also with a ring gear 21 fixed to a motor mounting base 19, is supported by two carriers 23 and 24 which are respectively disposed forward and backward in the axial direction of the planetary mechanism 3; and, especially, the axially front-side (on the side of the output shaft 60) drive carrier 24 is disposed so as to slide freely in the axial direction thereof and also includes an engagement portion 25 which can be freely slided in the axial direction through key connection such as spline or serration to the rear end portion of the drive shaft 4. The rotation of the motor 2 is reduced by the planetary mechanism 3 and is then transmitted through the drive carrier 24 to the drive shaft 4.

Figure 18:
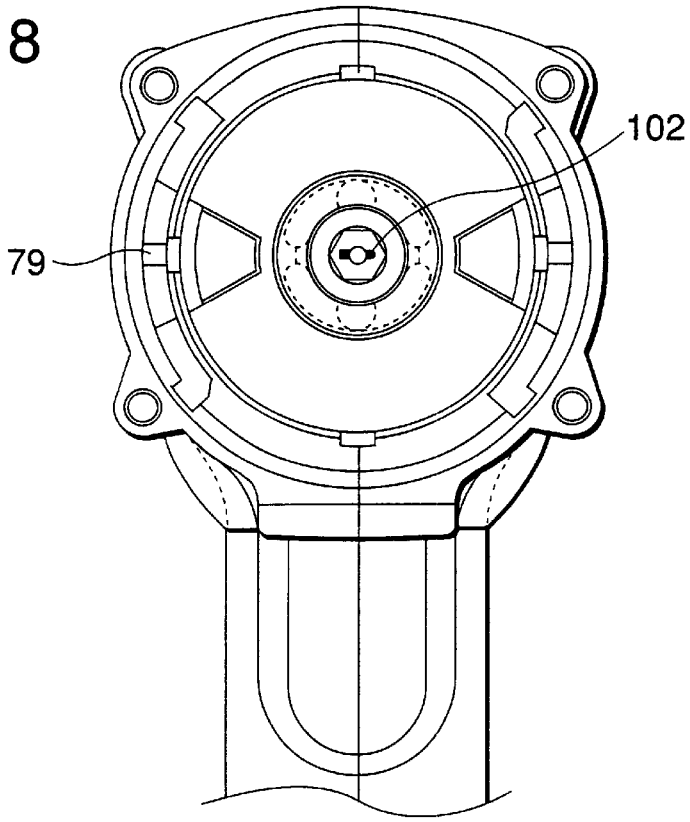
Figure 19:
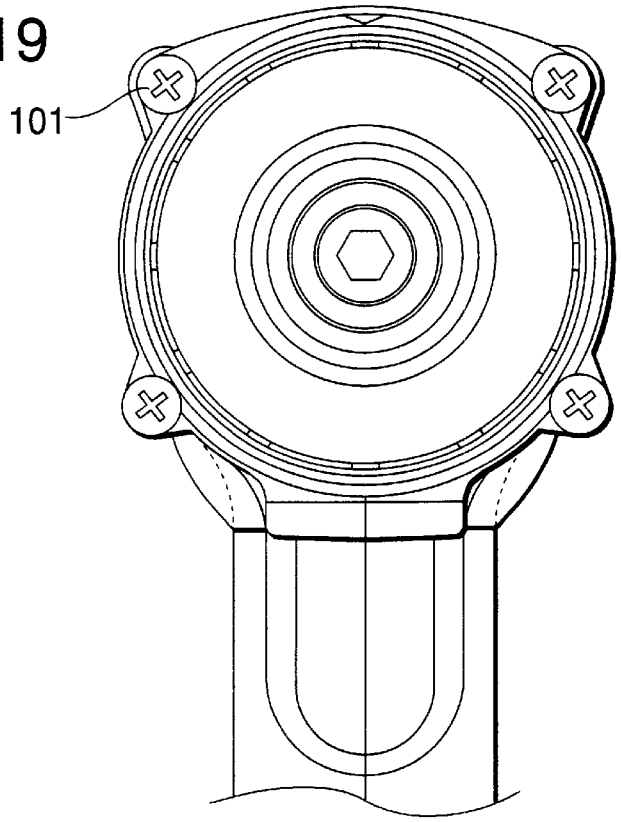
Figure 20:
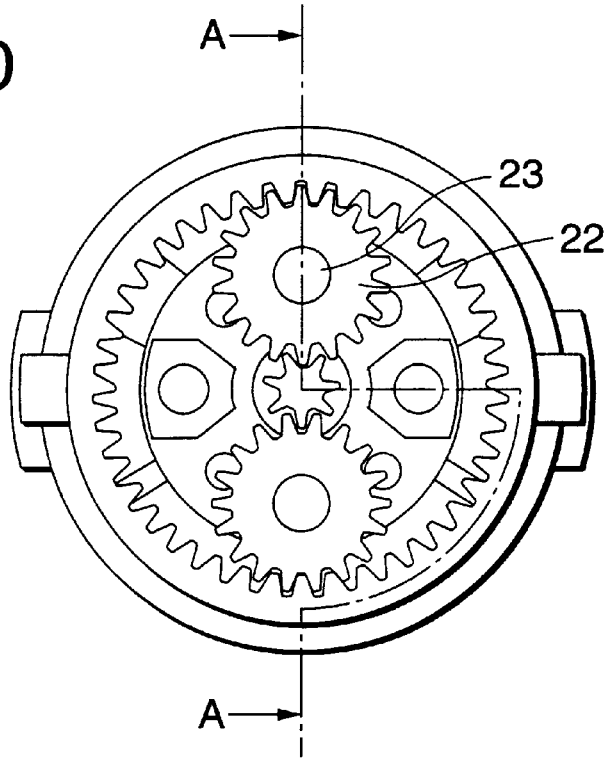
Figure 21:
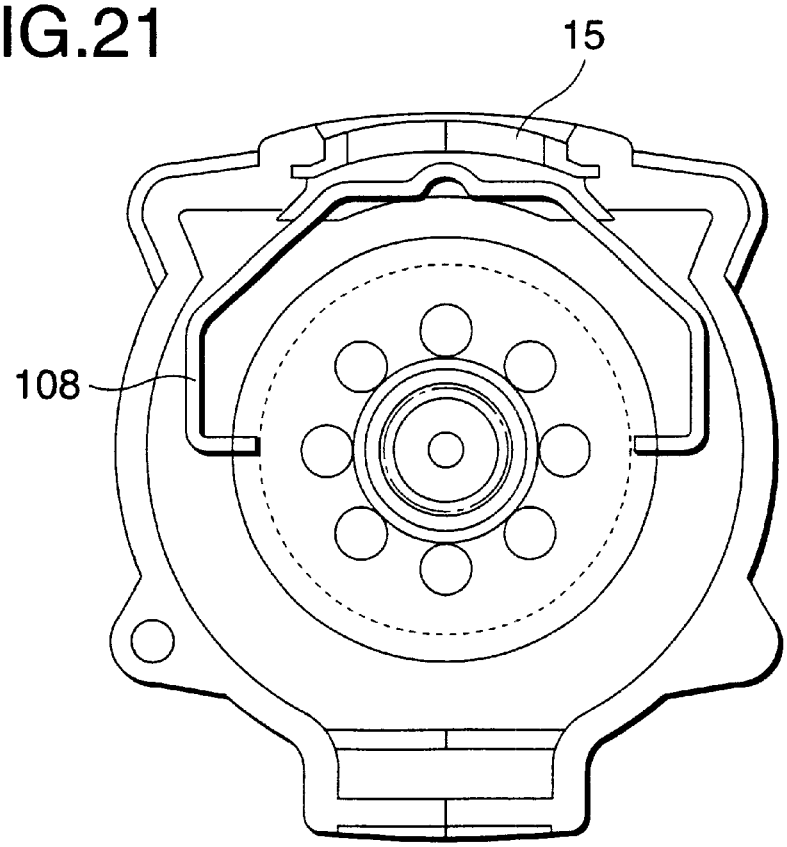

In this embodiment, the planetary gear 22 is supported by the carriers 23 and 24. Of course, as shown in FIG. 18, it is applicable for a planetary gear supporting structure such that the planetary gear 22 is supported by the carrier 23, only.

Also, in the center of the drive shaft 4, there is disposed a switching pin 35 and, in the tip end portion of the drive shaft 4, there is formed a recessed portion serving as an engagement portion 42; and, within the engagement portion 42, there is disposed a connecting member 36 which is used to connect the drive shaft 4 directly to the output shaft 60. The switching pin 35, the rear end of which is pressed into and fixed to the drive carrier 24, holds the connecting member 36 rotatably in the portion of the tip end thereof that is formed so as to have a small diameter, while the connecting member 36 is prevented against removal by a retaining ring By the way, the connecting member 36 and engagement portion 42 are structured such that, as will be discussed later, they have specially designed sections, can be rotated integrally with each other, and can be slided freely in the axial direction thereof.

Namely, the drive shaft 4 rotation is not same as the switching pin 35. As a result, the connecting member 36 rotates freely with respect to the switching pin 35. In stead of the retaining ring, it is capable for using a spring pin 102 inserted into a hole provided on the small diameter portion as shown in FIGS. 18.

And, on the rear end face of the output shaft 64 there are formed a hold portion 63 into which the tip end portion of the drive shaft 4 can be fitted in a loosely rotatable manner, and an engagement portion 64 which can be freely engaged with the connecting member 36. This engagement portion 64 also has a specially designed, section, can be freely slided with respect to the connecting member 36 in the axial direction thereof and can be rotated integrally with the connecting member 36.

On the outer surface of the housing 1, there is disposed an operation member 15 in such a manner that it can be freely slided in the back-and-forth direction thereof. The operation member 15 includes on the inner surface side thereof a movable bar 16 which is energized from the back-and-forth direction thereof by elastic bodies 17, 17 such as springs, while the movable bar 16 is engaged with an annular-shaped groove 26 formed on the outer peripheral surface of the drive carrier 24.

Here, as shown in FIG. 1, while the operation member 15 is held in its retreated state, the drive carrier 24 is also in its retreated state, and the connecting member 36 connected to the drive carrier 24 by the switching pin 35 is situated within the engagement portion 42 formed in the drive shaft 4. In this state, in case the motor 2 is driven, the rotation of the motor 2 is reduced by the. planetary mechanism 3 and is then output from the drive gear 4 through the hammer 5 and anvil 6 to the output shaft 60. In case where a load of a given level or more is applied to the output shaft 60, the impact mechanism brings the hammer 5 and anvil 6 into intermittent impact engagement with each other to thereby execute an impact operation. At the then time, since the drive carrier 24 is freely rotatable with respect to the movable bar 16, there is no possibility that a rotary load can be applied to the drive carrier 24.

On the other hand, as shown in FIG. 2, in case where the operation member 15 is slided forward, the drive carrier 24 also moves forward through the movable bar 16, when the connecting member 36 is engaged with both the engagement portion 42 of the drive shaft 4 and the engagement portion 64 of the output shaft 60, so that the rotation of the drive shaft 4 is transmitted through the connecting member 36 to the output shaft 60. That is, there is produced a state in which the drive shaft 4 and anvil 6 (output shaft 60) are connected directly with each other in such a manner that they are disabled from rotating with respect to each other. In this manner, since by operating the connecting member 36 situated within the interior portions of the drive shaft 4 and anvil 6 (output shaft 60) from outside using the operation member 15, the connecting conditions between the drive shaft 4 and anvil 6 can be switched over to each other, not only the impact and drill operations can be easily switched over to each other by the external operation but also the efficiency of the power transmission can be prevented from lowering.

By the way, when the drive carrier 24 is moved, the planetary gear 22 is prevented against movement by a projecting portion which is provided on the inner periphery side of one end of the ring gear 21. Also, in FIG. 1, reference character $B_1$ designates a bearing which is used to support the carrier 23, $B_2$ stands for a bearing used to support the drive shaft 4 through a gear case 18, and $B_3$ a bearing for supporting the output shaft 60.

Second Embodiment

Figure 3:
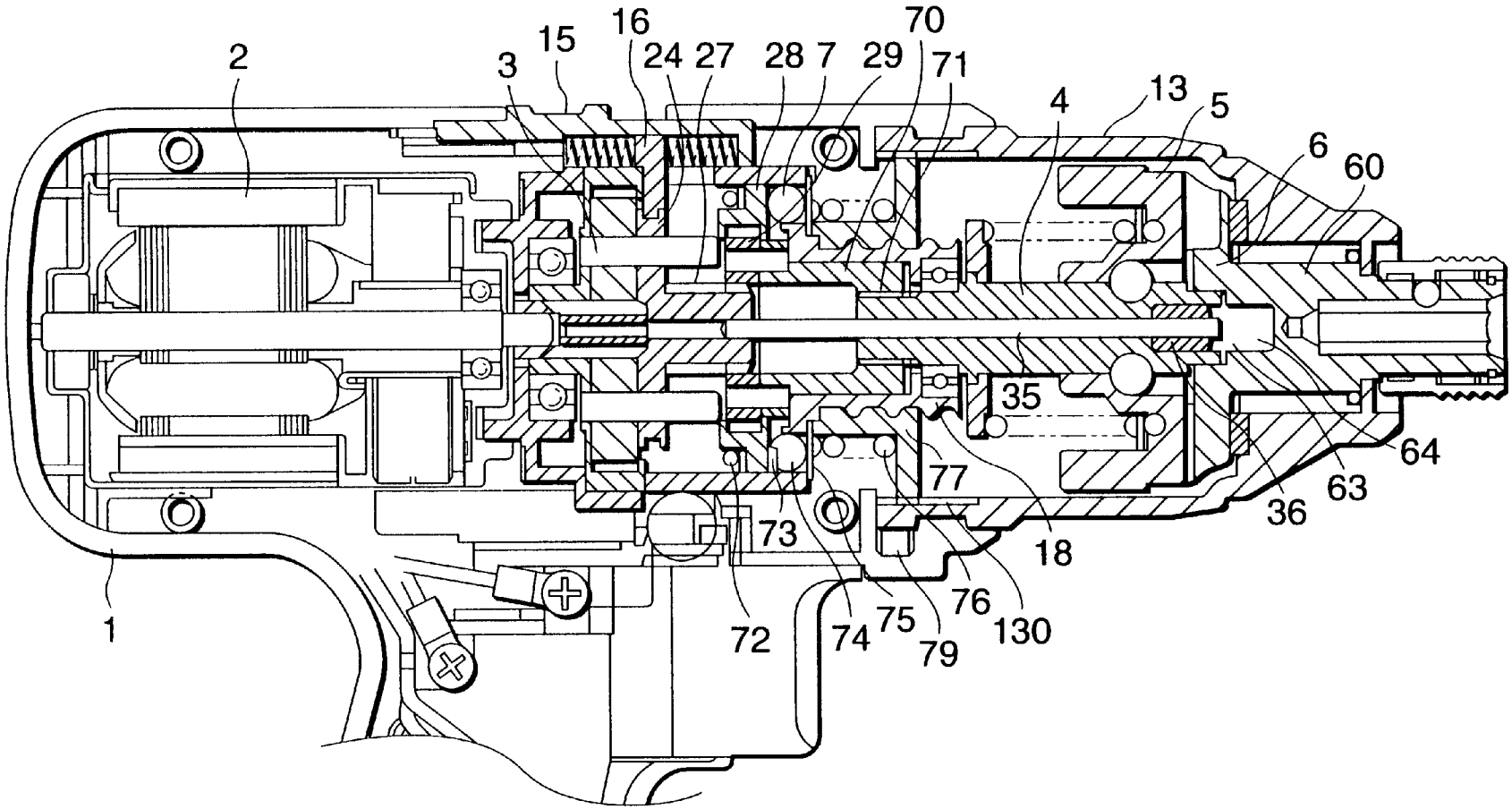
FIG. 3 is a longitudinal section view of a second embodiment of an impact rotary tool according to the invention.
Figure 4:
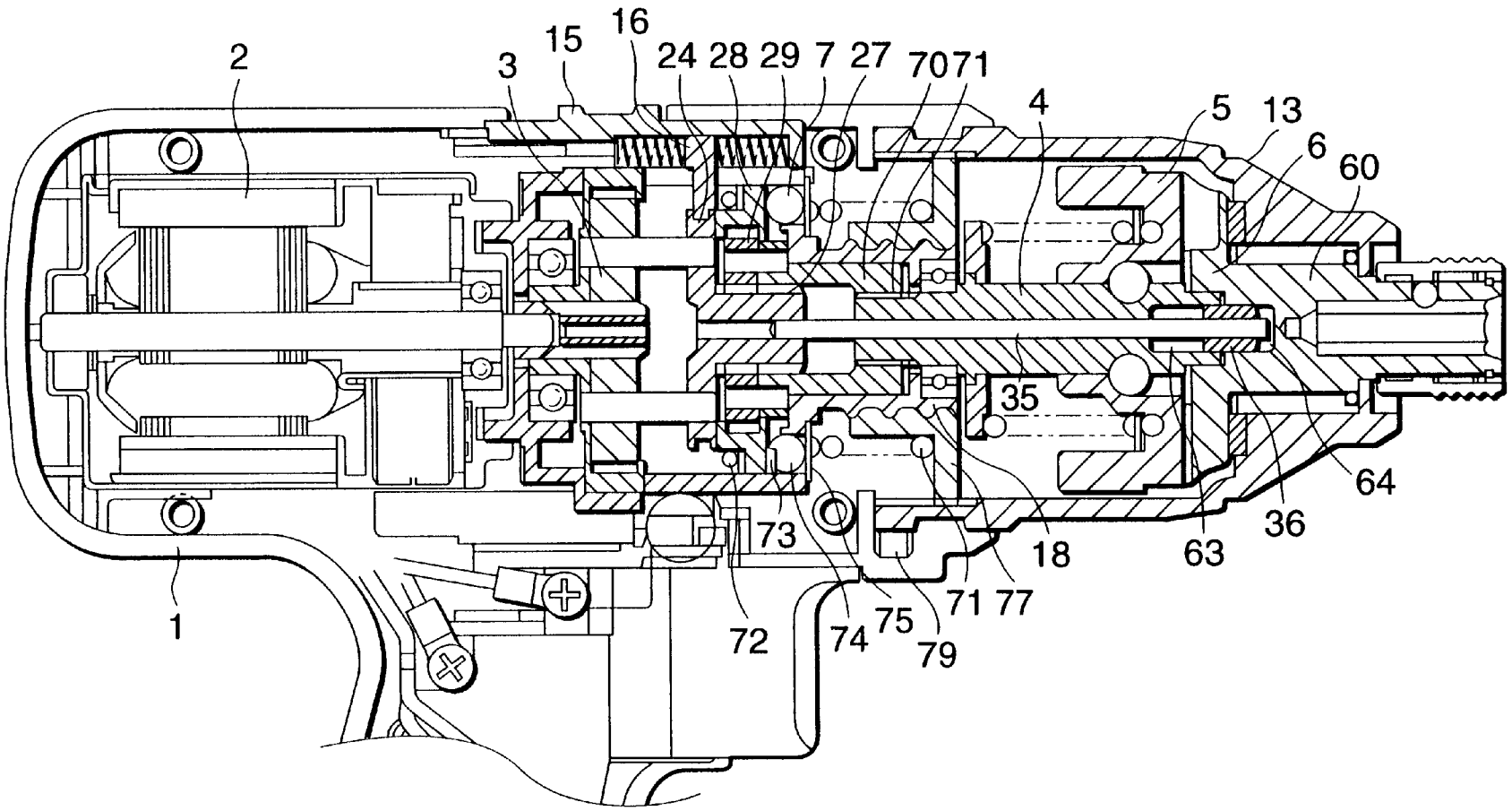
FIG. 4 is a longitudinal section view of the second embodiment, showing a state thereof in which the operation thereof is switched.

Now, FIGS. 3 and 4 show a second embodiment of an impact rotary tool according to the invention. In this embodiment, in order that an adjusting function for adjusting a tightening torque can work well when the drive shaft 4 and output shaft 60 are used in a directly connected condition, there is additionally provided a torque clutch 7; and, the torque clutch 7 is interposed between the planetary mechanism 3 and drive shaft 4. That is, in the tip end portion of the gear case 18, there are disposed a planetary gear 29 held by a transmission carrier 70, and a loosely rotatable ring gear 28, while the planetary gear 29 is meshingly engaged with a sun gear 27 disposed in the drive carrier 24 and also with the ring gear 28.

Also, on the outer peripheral surface of the tip end portion of the gear case 18, there is formed a male screw, and an adjust screw 77 is threadedly engaged with the male screw of the outer peripheral surface of the gear case 18; and, part of the adjust screw 77 is slidably engaged with a groove 130 formed in the inner surface of a drive portion cover 13 which not only covers the outer portion of the impact mechanism but also can be rotated around its own axis with respect to the housing 1.

Further, in the gear case 18, there is formed a through hole which extends through the gear case 18 in the axial direction thereof and, in this through hole, there is disposed a steel ball 74, while there are interposed a thrust plate 75 and a clutch spring 76 between the steel ball 74 and adjust screw 77. And, on the tip end face of the ring gear 28, there is provided a projecting portion which can be engaged with the steel ball 74. In FIGS. 3 and 4, reference character 72 designates a pin which is used to prevent the ring gear 28 from moving in the axial direction thereof.

The transmission carrier 70 includes a connecting engagement portion 71 which is used to connect the transmission carrier 70 to the rear end portion of the drive shaft 4, while the sun gear 27 in the drive carrier 24 and the planetary gear 29 are formed so as to be freely slidable in the axial direction thereof.

In the thus structured second embodiment, when attempting to obtain an impact operation, as shown in FIG. 3, the drive carrier 24 and connecting member 36 are moved back by operating the operation member 15 to thereby connect the drive shaft 4 and output shaft 60 directly and, at the same time, the drive cover 13 is rotated to thereby rotate and move back the adjust screw 77 into contact with the thrust plate 75, so that the steel ball 74 is prevented from moving against the clutch spring 76. As a result of this, the ring gear 28 is fixed, while the rotation of the motor 2 is transmitted from the planetary mechanism 3 through another planetary mechanism, which is composed of the sun gear 27, ring gear 28, planetary gear 29 and transmission carrier 70, to the drive shaft 4, so that an impact output caused by the impact engagement between the hammer 5 and anvil 6 can be applied to the output shaft 60.

When attempting to use the present embodiment as an electric drill, while the torque clutch 7 is left in the state shown in FIG. 3, the operation member 15 may be moved forward. In response to this, the connecting member 36 is moved forward through the drive carrier 24 and switching pin 35 and thus the connecting member 36 connects the drive shaft 4 and output shaft 60 directly to thereby cancel the impact mechanism.

To use the present embodiment as an electric driver in which a tightening torque is controlled, as shown in FIG. 4, the operation member 15 is moved forward to thereby connect the drive shaft 4 and output shaft 60 directly and, at the same time, the drive portion cover 13 is rotated to move forward the adjust screw 77, thereby producing a state in which the steel ball 74 in engagement with the ring gear 28 can be moved against the clutch spring 76 and can be thereby removed from its engagement with the ring gear 28.

In this state, in case where the output shaft 60 is driven from the drive shaft 4 through the connecting member 36 to thereby increase the load torque, the ring gear 28 starts to idle so that he transmission of the rotation of the motor is cut off. Since the torque at the then time corresponds to the compression quantity of the clutch spring 76 by the adjust screw 77, by adjusting the position of the adjust screw 77 through the rotation of the drive portion cover 13, the tightening torque can be controlled. By the way, on the outer periphery of the drive portion cover 13, there is formed an uneven portion with which a click spring 79 mounted on the inner surface of the housing 1 can be engaged, thereby being able to facilitate the control of the tightening torque.

Third Embodiment

Figure 5:
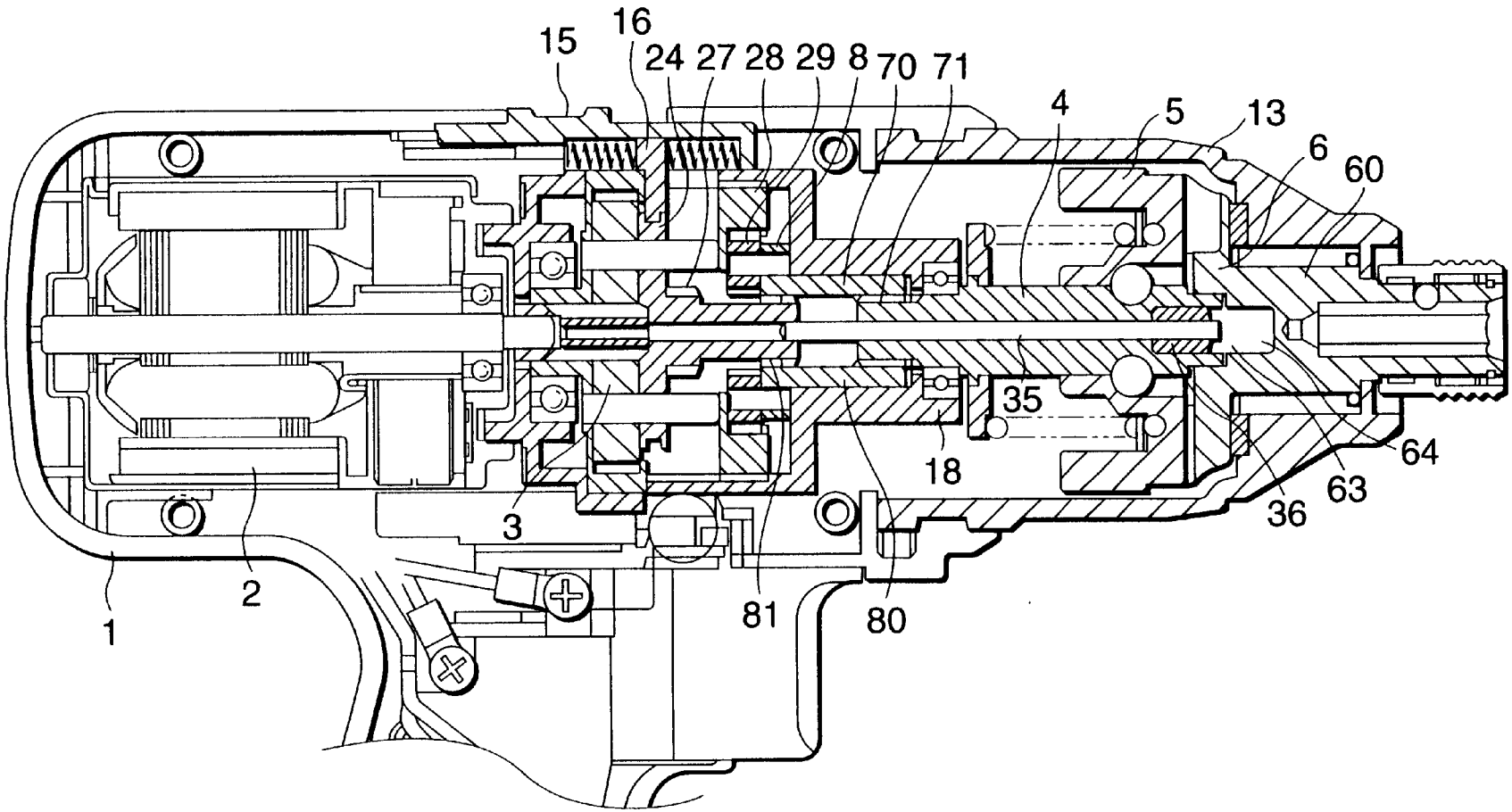
FIG. 5 is a longitudinal section view of a third embodiment of an impact rotary tool according to the invention.
Figure 6:
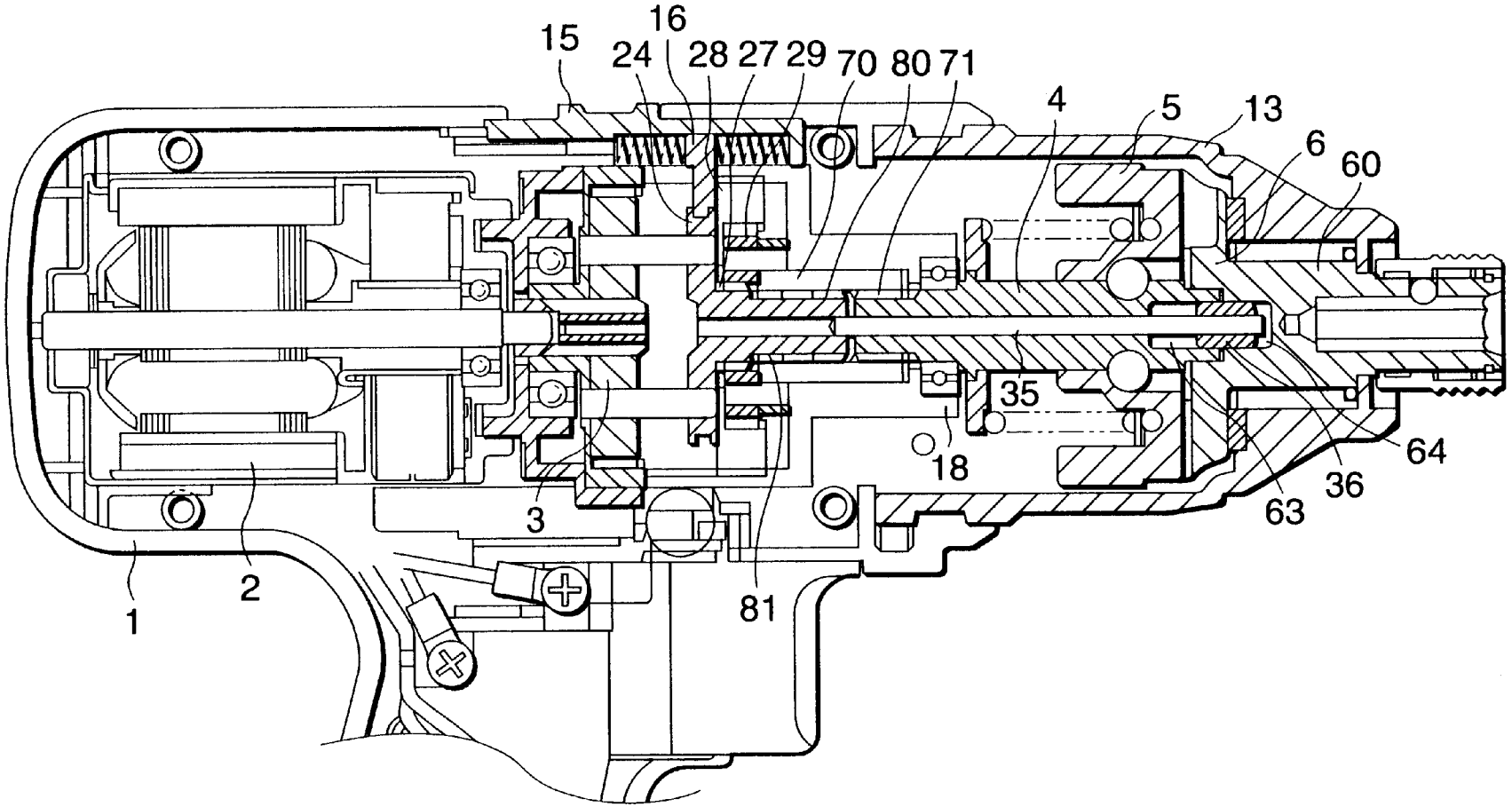
FIG. 6 is a longitudinal section view of the third embodiment, showing a state thereof in which the operation thereof is switched.

Now, FIGS. 5 and 6 show a third embodiment of an impact rotary tool according to the invention. In this embodiment, in a power transmission route from the drive carrier 24 to the drive shaft 4, there is disposed speed change means 8 which consists of a planetary mechanism: that is, in the speed change means 8, in the tip end portion of the gear case 18, there are disposed a planetary gear 29 held by a transmission carrier 70, and a ring gear 28 fixed to the gear case 18; in the drive carrier 24, there are disposed a sun gear 27 and a direct connecting gear 80; and, on the inner peripheral surface of the transmission carrier 70, there are formed not only a connecting engagement portion 71 to be engaged with the drive shaft 25 but also an engagement portion 81 to be meshingly engaged with the direct connecting gear 80 disposed in the tip end portion of the drive carrier 24.

As shown in FIG. 5, while the drive carrier 24 is held in its retreated position, although the sun gear 27 disposed in the drive carrier 24 is not meshingly engaged with the planetary gear 29, the direct connecting gear 80 disposed in the drive carrier 24 is in meshing engagement with the engagement portion 81 of the transmission carrier 70 and, therefore, after the rotation of the motor 2 is reduced by the planetary mechanism 3, the rotation of the motor 2 is transmitted from the drive carrier 24 through the transmission carrier 70 to the drive shaft 4. At the then time, since the connecting member 36 is not connecting the drive shaft 4 with the output shaft 60 directly, the rotation of the drive shaft 4 is transmitted through the hammer 5 and anvil 6 to the output shaft 60 and, in case where the load is equal to or more than a given load level, an impact operation can be carried out.

However, as shown in FIG. 6, in case where the operation member 15 is slided to thereby move forward the drive carrier 24, the direct connecting gear 80 disposed in the drive carrier 24 is removed from its engagement with the engagement portion 81 of the transmission carrier 70, the sun gear 27 disposed in the drive carrier 24 is meshingly engaged with the planetary gear 29, and further the connecting member 36 connects the drive shaft 4 to the output shaft 60 directly. Therefore, after the rotation of the motor 2 is reduced by the planetary mechanism 3, the rotation of the motor 2 is transmitted from the sun gear 27 disposed in the drive carrier 24 through the planetary gear 29 to the transmission carrier 70 and drive shaft 4, and is then transmitted to the output shaft 60 which is directly connected with the drive shaft 4 by the connecting member 36. At the then time, between the drive carrier 24, switching pin 35 and the connecting member 36, there is produced a difference in the rotation speed; however, since the connecting member 36 is mounted such that it can be freely rotated with respect to the switching pin 35, there is no fear that the switching pin can be twisted off.

In this case, since the rotation is transmitted to the output shaft 60 after the rotation is reduced by the two-stage planetary mechanisms, the rotation torque of the output shaft 60 is large and, therefore, when using the present embodiment as a drill, even when the output of the motor 2 is not increased, a large hole can be drilled, which makes it possible to reduce the size of the product or impact rotary tool.

Fourth Embodiment

Figure 7:
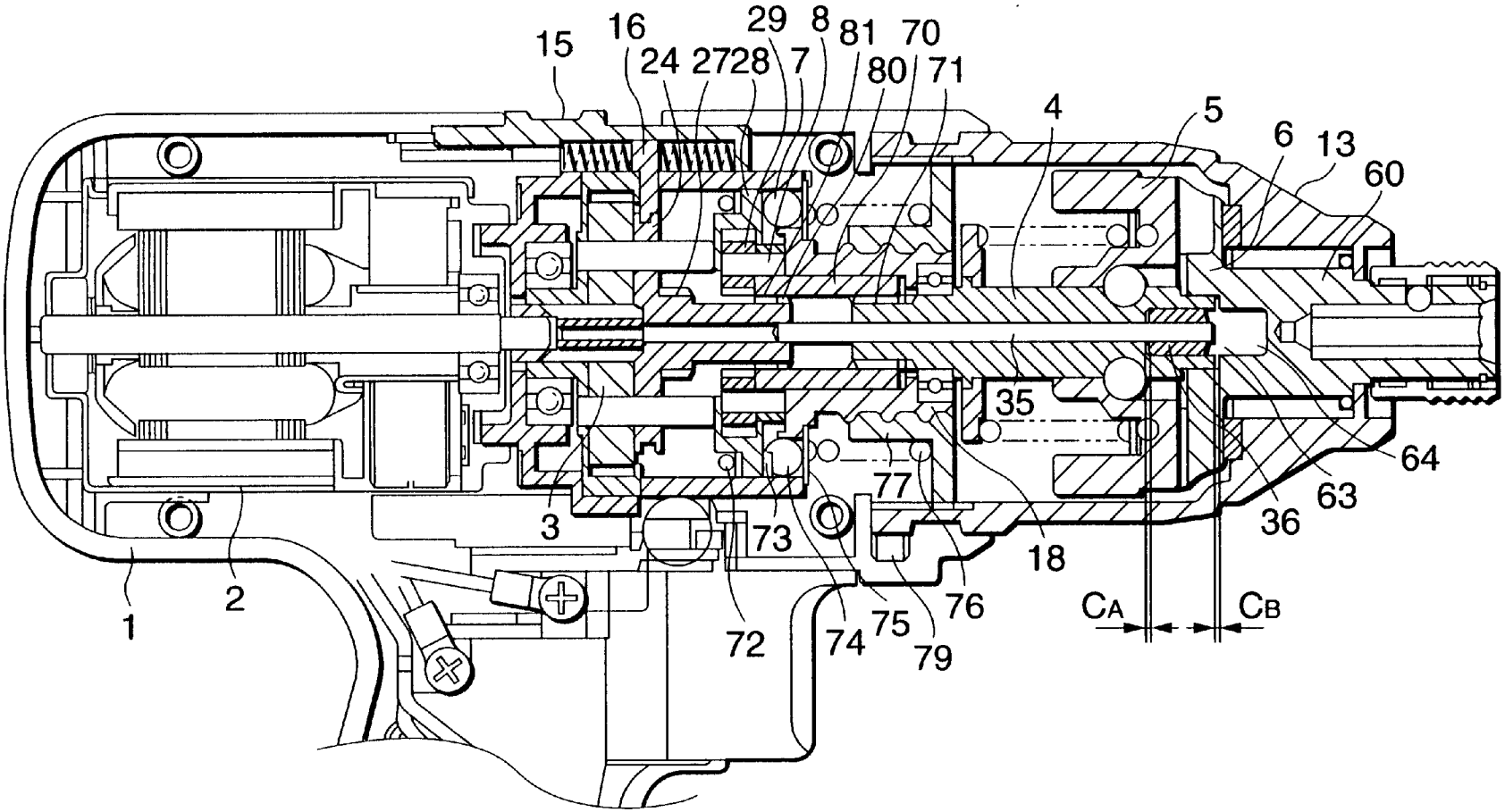
FIG. 7 is a longitudinal section view of a fourth embodiment of an impact rotary tool according to the invention.
Figure 8:
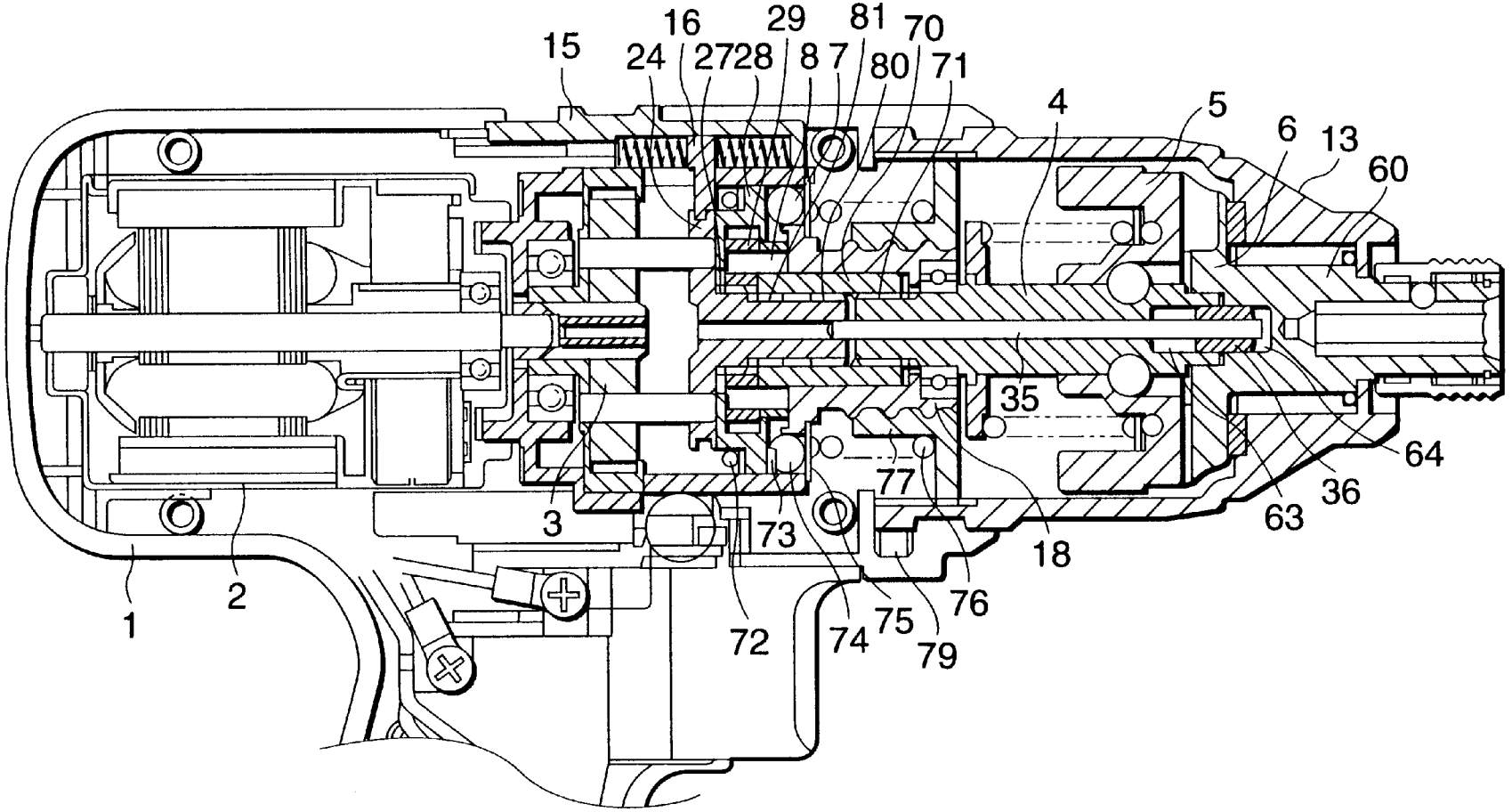
FIG. 8 is a longitudinal section view of the fourth embodiment, showing a state thereof in which the operation thereof is switched.

Now, FIGS. 7 and 8 show a fourth embodiment of an impact rotary tool according to the invention, in which there are employed both of the above-mentioned torque clutch 7 and speed change means 8. However, in the torque clutch 7 and speed change means 8, the ring gear 28, planetary gear 29 and transmission carrier 70 are used in common. That is, the transmission carrier 70, which is used in the embodiment shown in FIGS. 3 and 4 and including the torque clutch 7, is structured such that it includes the engagement portion 81 shown in FIGS. 5 and 6; and, the drive carrier 24 is structured such that it includes the sun gear 27 and direct connecting gear 80 respectively shown in FIGS. 5 and 6.

When carrying out an impact operation, as shown in FIG. 7, the drive carrier 24 is moved back to bring the direct connecting gear 80 into engagement with the engagement portion 81 to thereby connect the drive carrier 24 directly with the transmission carrier 70 and, after then, the drive shaft 4 is rotated; and, the rotation of the drive shaft 4 is transmitted through the hammer 5 and anvil 6 to the output shaft 60. At the then time, since the sun gear 27 of the drive carrier 24 is not in meshing engagement with the planetary gear 29 supported by the transmission carrier 70, the torque clutch 7 is not operated. Therefore, there is no fear that the torque clutch 7 has an influence on the impact operation.

On the other hand, when using the present embodiment as a driver capable of controlling a tightening torque, as shown in FIG. 8, the operation member 15 is operated to thereby move forward the drive carrier 24, so that the direct connecting gear 80 disposed in the drive carrier 24 is removed from its engagement with the engagement portion 81 of the transmission carrier 70, at the same time, the sun gear 29 disposed in the drive carrier 24 is meshingly engaged with the planetary gear 29, and further the drive shaft 4 is connected directly with the output shaft 60 by the connecting member 36. Thanks to this, after the rotation of the motor 2 is reduced by the planetary mechanism 3, the rotation of the motor 2 is further reduced by the sun gear 27 disposed in the drive carrier 24, ring gear 28, planetary gear 29 and transmission carrier 70 and is then transmitted to the drive shaft 4; and, after then, the rotation of the motor 2 is transmitted to the output shaft 60 connected directly to the drive shaft 4 by the connecting member 36. And, in case where the load torque increases, the ring gear 28 starts to idle to thereby cut off the transmission of the rotation, so that the tightening torque can be restricted. In the present embodiment as well, similarly to the previously described embodiments, the tightening torque can be controlled by the adjust screw 77.

When using the present embodiment as a driver, since the rotation of the motor can be cut off by in accordance with the torque that is set, it is possible to screw screws into lumber at a uniform height, to tighten a screw into a plastic member which, in case where the screw is tightened more than necessary, causes the screw not to work, and to tighten a screw with a proper torque in order to prevent the screw from loosening. Also, since the rotation is reduced by the two-stage planetary mechanisms, tightening with a large torque is possible. Of course, when using as a drill as well, when compared with the case of no execution of the speed change, a large hole can be drilled without increasing the output of the motor 2. In addition to this, here, in the torque clutch 7 and speed change means 8, not only because a large number of parts are used in common but also because they can be disposed coaxially with the motor 2, the product, namely, the drive portion tip end portion of the present impact rotary tool is prevented from increasing in size; that is, the product can be structured in a shape as small-sized as an tip end portion product.

Figure 9:
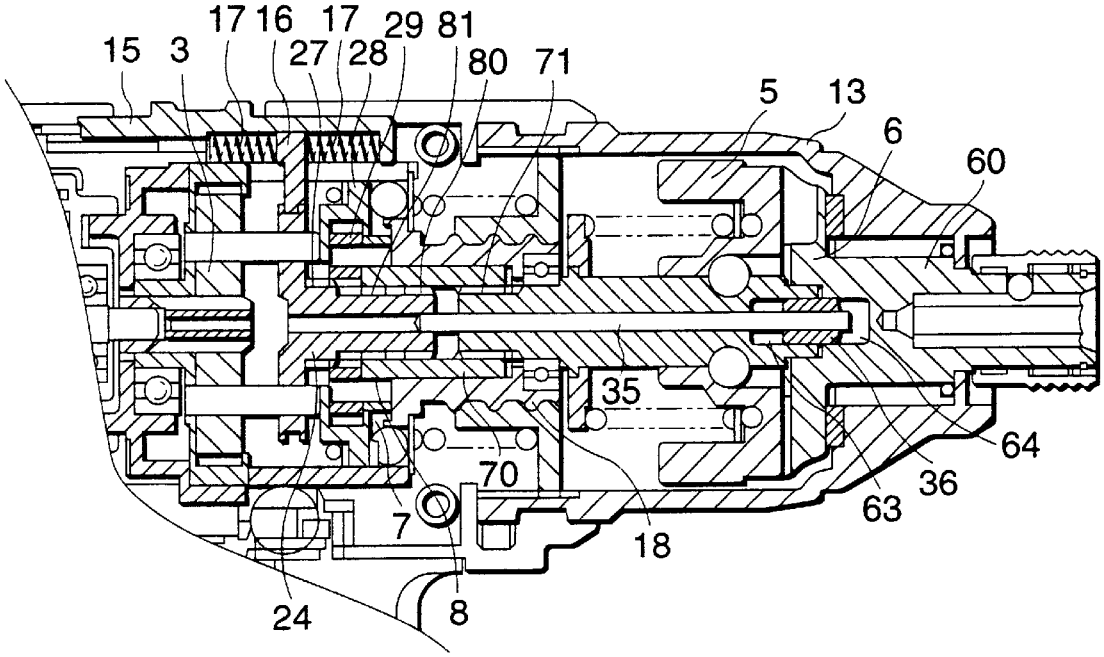
FIG. 9 is a longitudinal section view of the fourth embodiment, showing an intermediate state of the above switching operation thereof.

By the way, when the drive carrier 24 moves forward, as shown in FIG. 9, after the direct connecting gear 80 is removed from its engagement with the engagement portion 81 of the transmission carrier 70, the sun gear 27 meshes with the planetary gear 29 and, after then, the connecting member 36 connects the drive shaft 4 and output shaft 60 directly. This arrangement applies similarly in the embodiment shown FIGS. 5 and 6 as well.

In case where the direct connection between the drive shaft 4 and output shaft 60 by the connecting member 36 is achieved earlier than the meshing engagement between the sun gear 27 and planetary gear 29, when the connecting member 36 and the engagement portion 64 of the output shaft 60 are shifted in position from each other in the rotation direction thereof and they are thereby not engaged with each other, the sun gear 27 cannot be meshingly engaged with the planetary gear 29, thereby producing a state in which the rotation of the, motor cannot be transmitted. On the other hand, in case where the sun gear 27 is meshingly engaged with the planetary gear 29 earlier than the direct connection between the drive shaft 4 and output shaft 60 by the connecting member 36, the rotation of the motor is transmitted to the drive shaft 4 and thus the connecting member 36 can also be rotated together with the drive shaft 4 and, therefore, the position shift in the rotation direction between the connecting member 36 and the engagement portion of the output shaft 60 can be corrected to thereby allow them to be engaged with each other.

Also, during the impact operation, due to the movement of the hammer 5 in the thrust direction, the drive shaft 4 is also moved in the thrust direction by an amount corresponding to a thrust play $C_B$ shown in FIG. 7; and, at the then time, in case where the connecting member 36 is butted against the bottom portion of the engagement portion 63 of the drive shaft 63, the connecting member 36 receives a load in the thrust direction to thereby remove a retaining ring which prevents the connecting member 36 from being removed from the switching pin 35, which can result in the malfunction. To prevent this, a clearance $C_A$ (see FIG. 7) between the bottom portion of the engagement portion 63 of the drive shaft 4 and the connecting member 36 is set larger than the thrust play $C_B$ of the drive shaft 4 to thereby prevent the above load from being applied to the connecting member 36.

Figure 10:
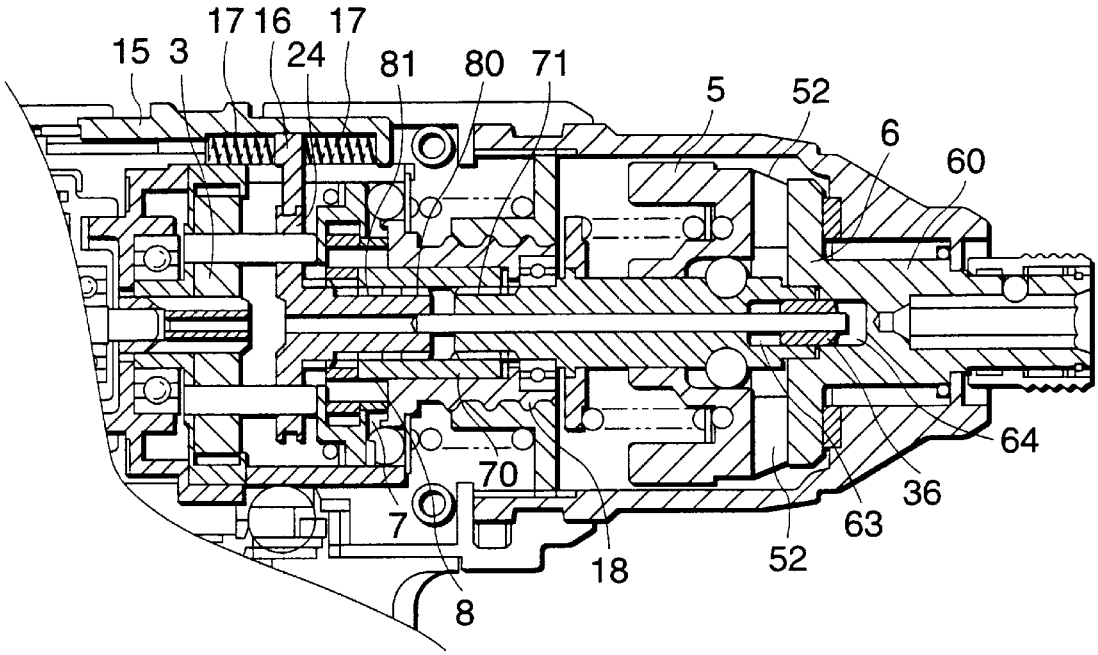
FIG. 10 is a longitudinal section view of the fourth embodiment, showing another intermediate state of the above switching operation thereof.
Figure 11:
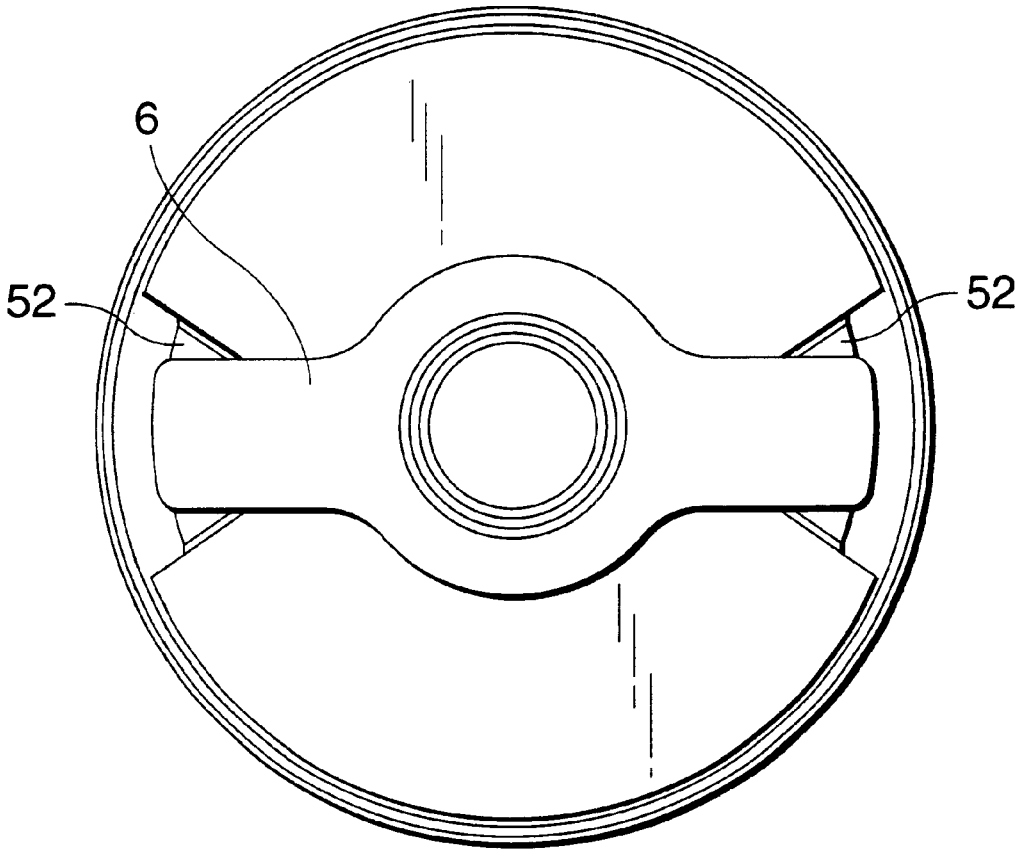
FIG. 11 is a front view of the fourth embodiment, showing a state thereof in which an hammer and an anvil are superimposed on each other.

Further, in case where the motor 2 is caused to stop during execution of the impact operation, as shown in FIGS. 10 and 11, there is a possibility that the projecting portion 52 of the hammer 5 can be stopped in a state where it runs up onto the anvil 6. In case where the drive shaft 4 and output shaft 60 (anvil 6) are directly connected to each other by the connecting member 36 while this state is maintained, the anvil 6 receives the spring load of the spring 55 in the thrust direction so that it is pressed against the thrust plate 68 and is thereby rotated, which lowers the efficiency of the rotation transmission.

Figure 12:
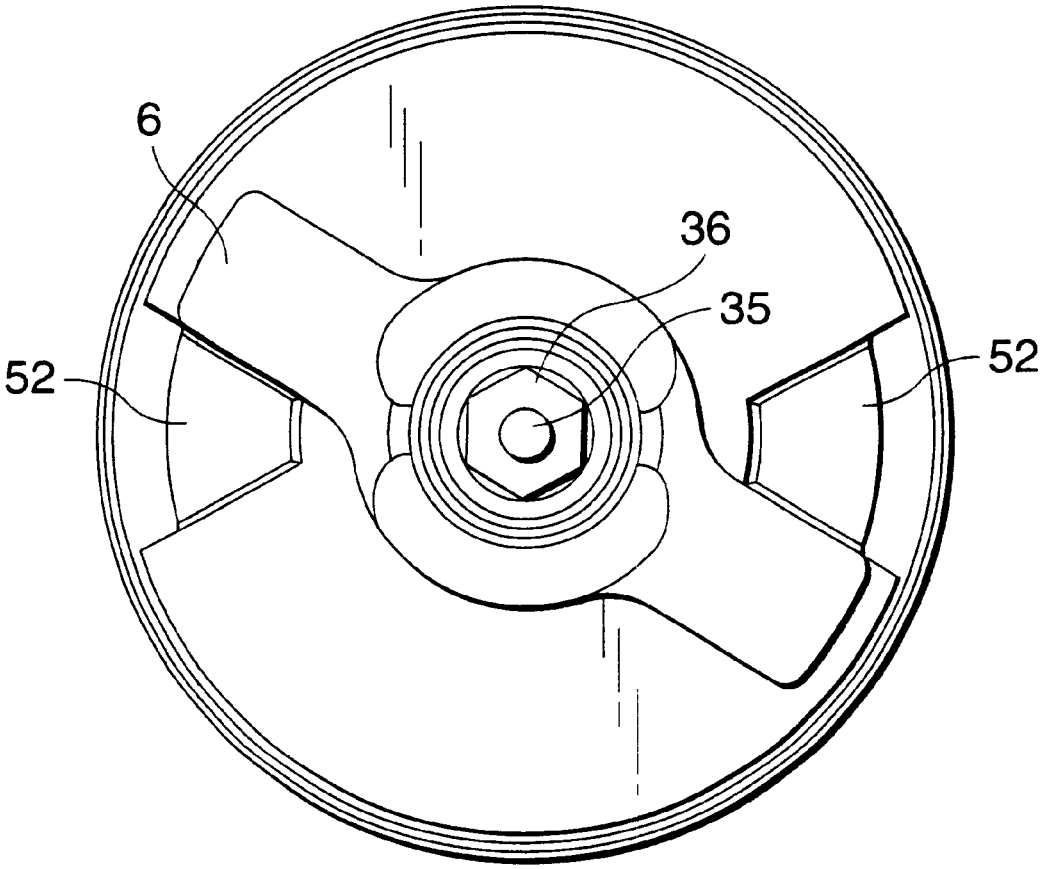
FIG. 12 is a front view of a hammer and an anvil, showing the shapes of a connecting member and the engagement portions of the hammer and anvil.

In view of this, in the present embodiment, as shown in FIG. 12, not only the connecting member 36 is formed so as to have a hexagonal section, but also the engagement portion 63 of the drive shaft 4 for storing the connecting member 36 therein and the engagement portion 64 of the output shaft 60 with which the connecting member 36 can be engaged are respectively formed so as to have a hexagonal section. Further, the position relation on axes between the anvil 6 and the engagement portion 64 consisting of a hole having a hexagonal section is set in such a manner that, when the connecting member 36 is fitted into and engaged with the engagement portion 64 on the anvil 6 side, the projecting portion 52 of the hammer 5 and anvil 6 can be kept from being superimposed on each other. That is, there is no possibility that the drive shaft 4 and output shaft 60 can be connected directly to each other in a state where the projecting portion 52 of the hammer 5 and anvil 6 are superimposed on each other; and, when using as a drill or an ordinary driver, there is no possibility that the anvil 6 can receive the load of the spring 55. Therefore, there is no possibility that the transmission efficiency can be lowered. Also, in case where the engagement portions 63, 64 of the anvil 6 and drive shaft 4 do not coincide with the connecting member 36 in shape, it is not possible to engage the connecting member 36 with the two engagement portions 63 and 64 at the same time by an external operation; however, as shown in FIG. 12, in case where the relation between the position of the projecting portion 52 and the positions of the section shapes of the connecting member 36 and engagement portions 63, 64 is set, in rotation (including both of forward rotation and reverse rotation), the anvil 6 rotates while it is engaged with the projecting portion 52 of the hammer 5; that is, in this state, they are always coincident with each other in shape and the connecting member 36 can be smoothly engaged with the engagement portion 64, which eliminates a wasteful operation for positioning.

By the way, in the above-mentioned respective embodiments, between the movable bar 16 to be engaged with the drive carrier 24 and the operation member 15 used to execute a switching operation from outside, there are interposed the elastic bodies 17, 17 so that a force applied to the operation member 15 is able to move the movable bar 16 through the elastic bodies 17. The reason for this is to be able to cope with the case in which, as described above, the anvil 6 and drive shaft 4 cannot be engaged with each other at once due to their mutual position relation around their axes. This applies similarly to the sun gear 27 and planetary gear 29 as well. Even in case where the operation member 15 is operated in a state in which the members to be engaged are held in such position relation that does not allow them to be engaged with each other, when the movable bar 16 is mounted directly on the operation member 15, the operation member 19 cannot be moved. On the other hand, in case where the elastic body 17 is interposed between the movable bar 16 and operation member 15, by compressing the elastic body 17, the operation of the operation member 15 can be completed and, at the same time, since the compressed elastic body 17 applies a load in the engaging direction to the engagement portions, when the engagement portions of the members to be engaged are matched to each other in the engagement position due to the rotation of the output shaft 60 or gear, they can be smoothly engaged with each other.

As shown in FIGS. 17 to 21, the modified embodiment is based on the forth embodiment. The modified portion as compared with the fourth embodiment will follow; The fixing structure the drive portion cover 13 to the housing 1 will follow. The drive portion cover 13 is attached to the housing 1 from the front side, and the cover 100 made of, for examples aluminum is attached to the housing to secure it by the screw 101 such that the drive cover 13 rotates freely. The click spring 79 is arranged between the housing 1 and the drive portion cover 13 to enhance the holding force for the drive portion cover 13.

Figure 15B:
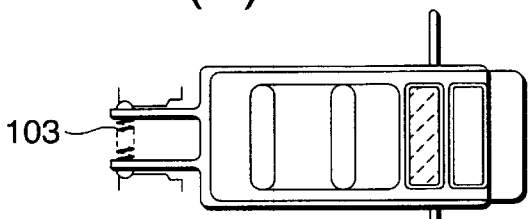
FIGS. 15 to 21 are front, longitudinal sectional views of the modified embodiment of the present invention.
Figure 15A:
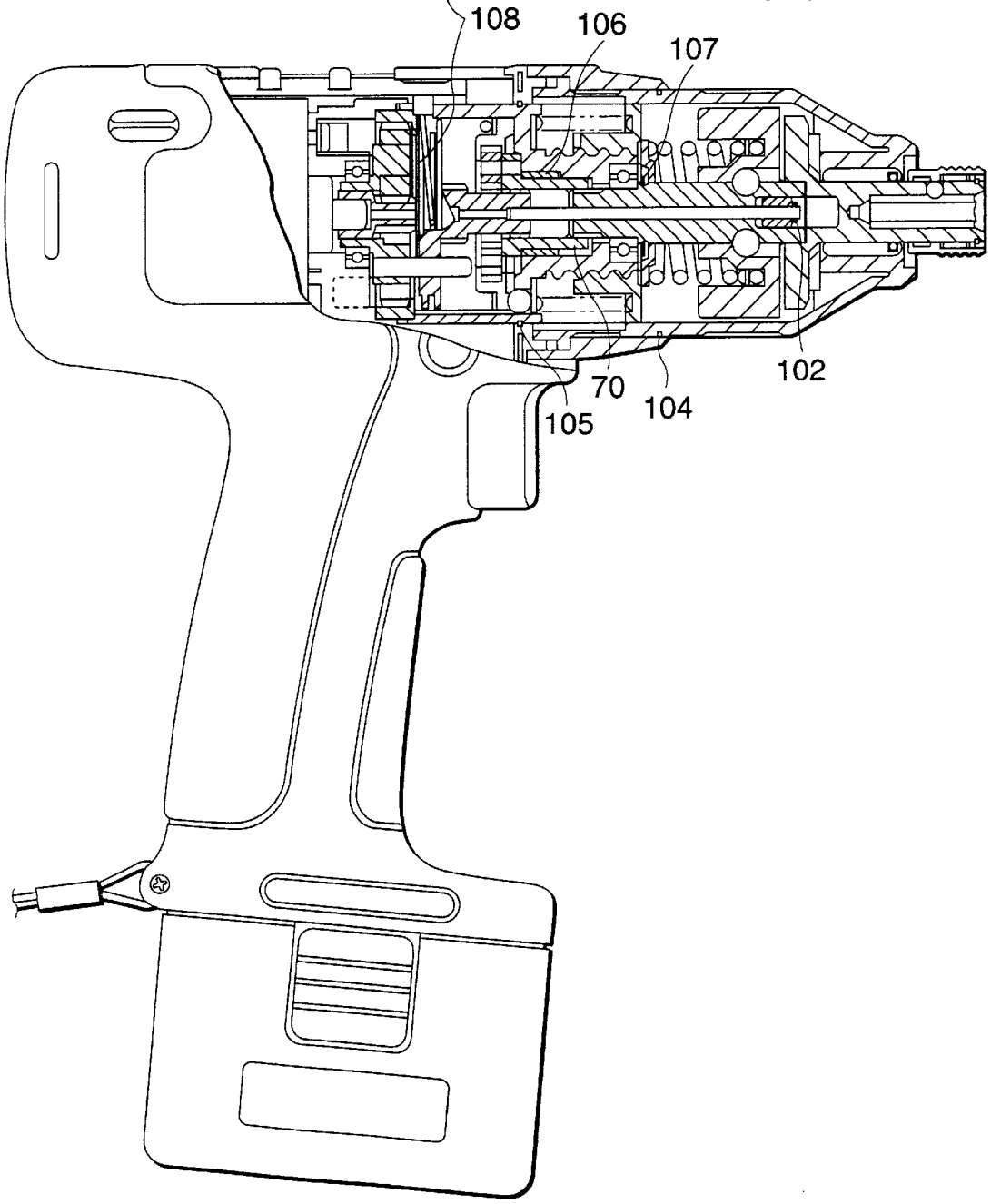
Figure 16:
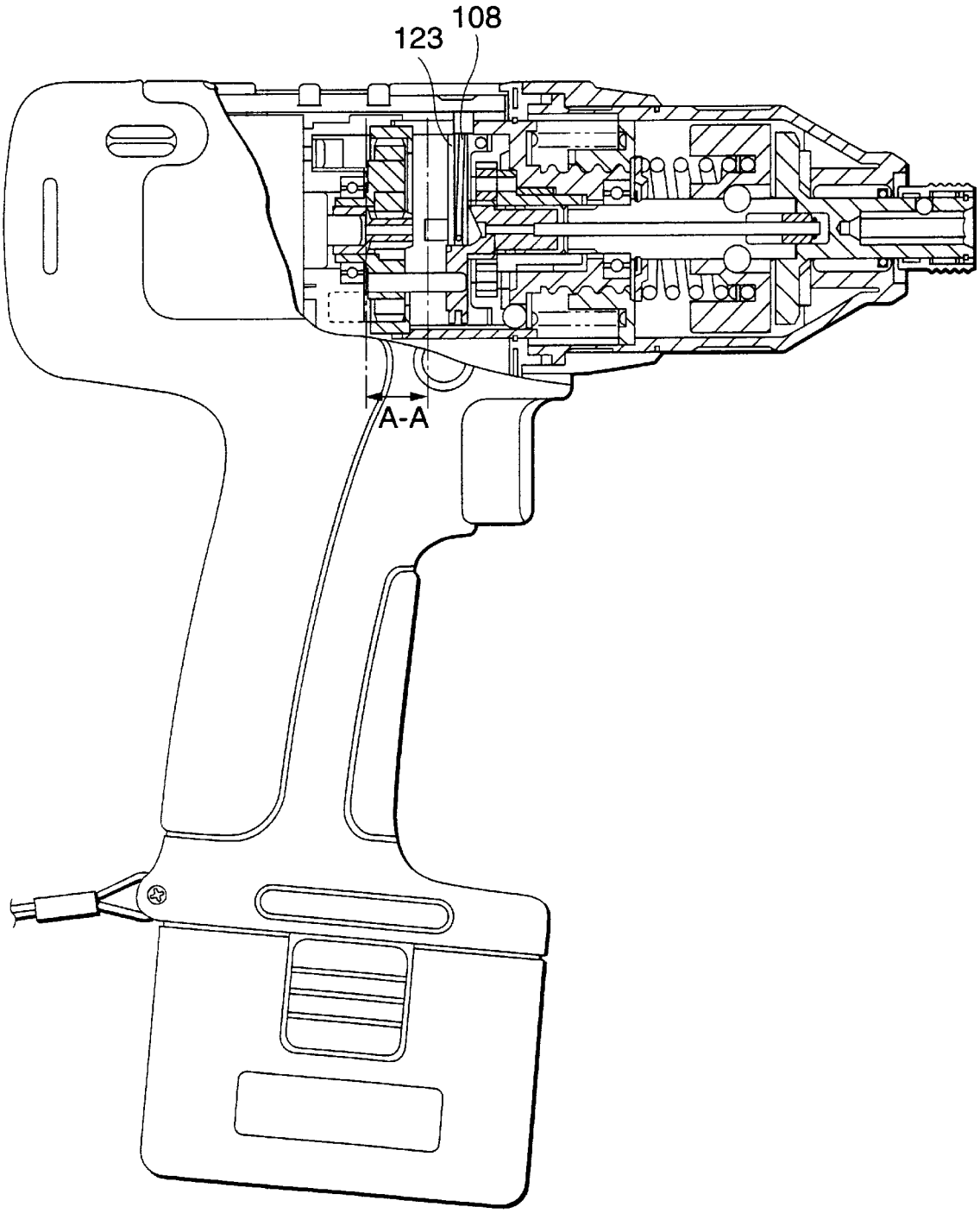
Figure 17:
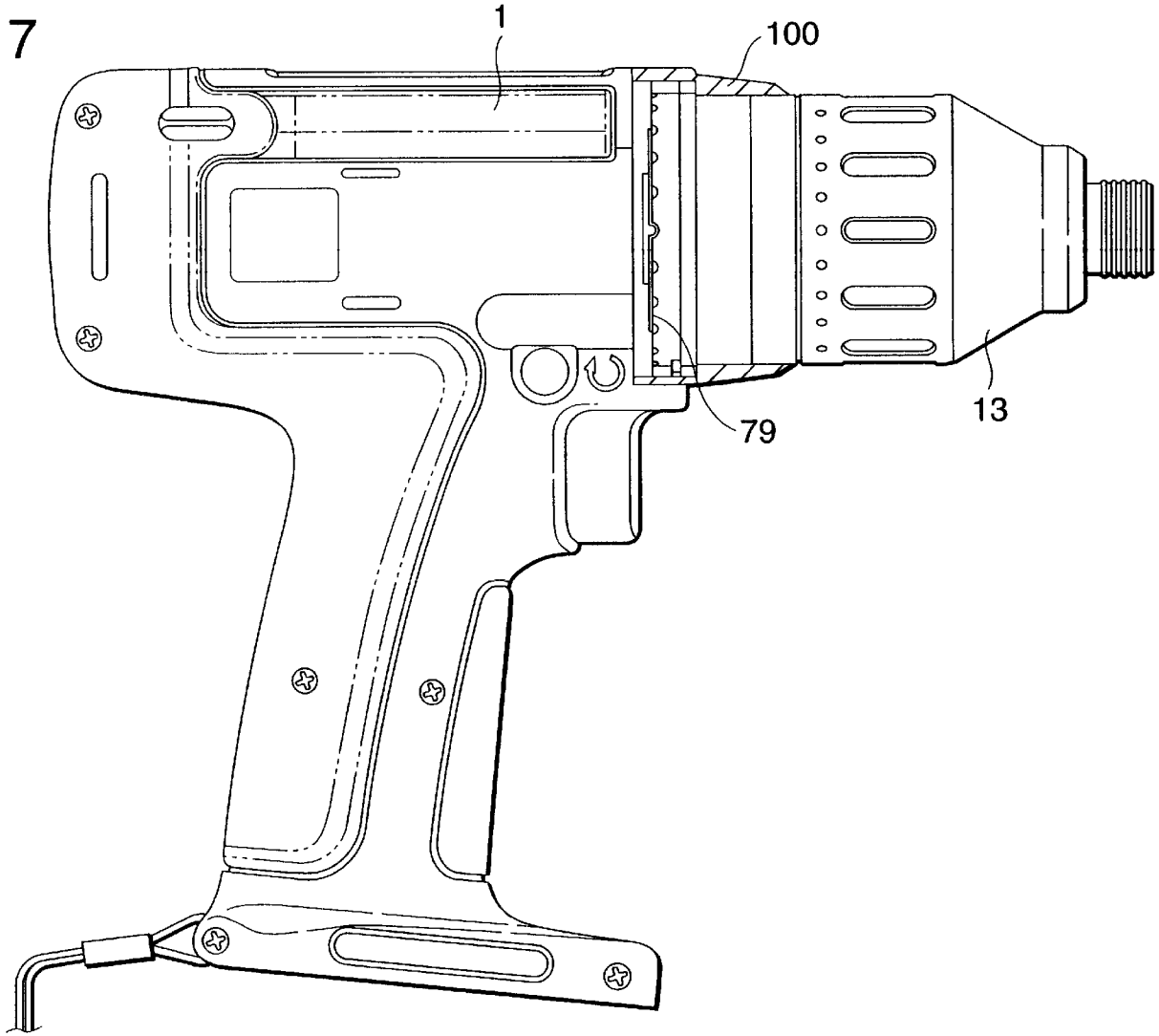

On the other hand, a line spring is applied as the elastic body. Namely as shown in FIGS. 15(A) and (B), 16 and 21, a line spring 108 is press-fitted or uniformly fixed on the operation member 15. A groove is formed on the carrier 123. The line spring 108 rotates freely within the grooves, whereas the line spring 108 moves only within the groove width in thrust direction.

In this configuration, in the case where the operation member is operated, the gear or connecting member does not meshed, the line member is deformed resiliently to apply the urging force. Thus, the switching portion comes during the rotation, the switching operation is performed smoothly.

Fifth Embodiment

Figure 13:
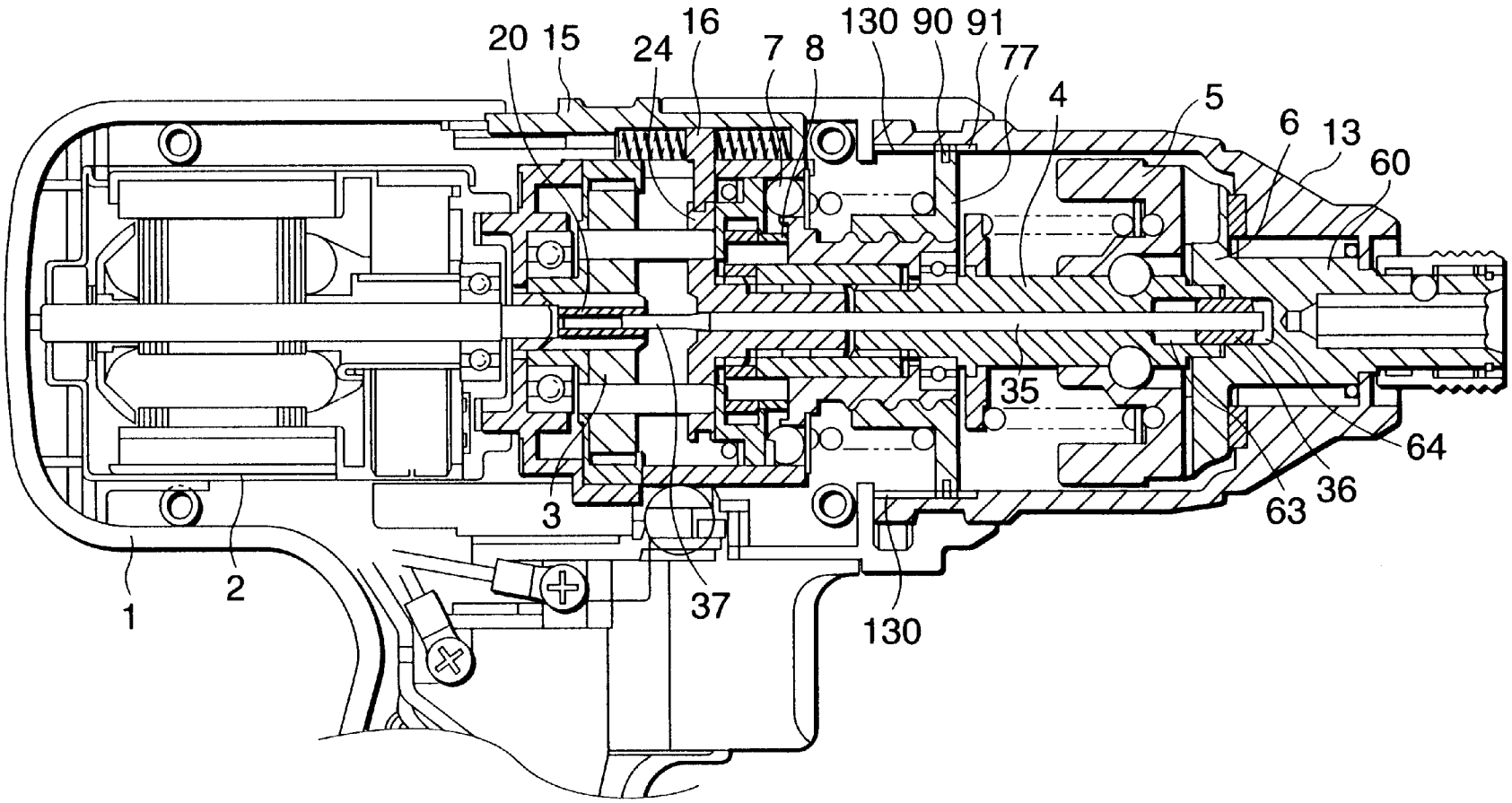
FIG. 13 is a longitudinal section view of a fifth embodiment of an impact rotary tool according to the invention.
Figure 14:
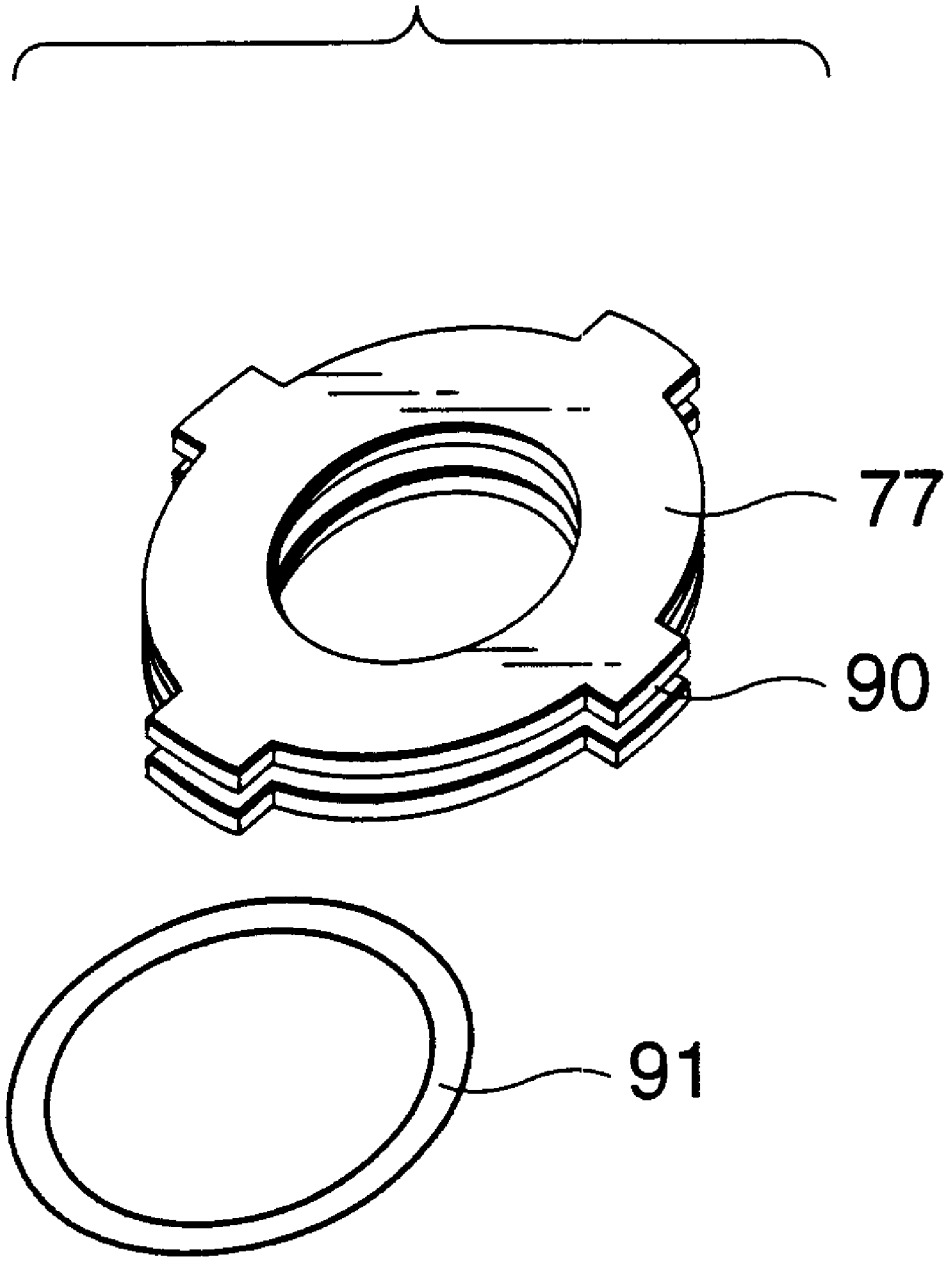
FIG. 14 is an exploded perspective view of an adjust screw employed in the fifth embodiment.

Now, FIG. 13 shows a fifth embodiment of an impact rotary tool according to the invention. In the present embodiment, the two following structures are added to the embodiment shown in FIGS. 7 and 8.

In one structure, there is formed a groove 90 in the outer peripheral portion of the adjust screw 77 disposed in the torque clutch 7 and, on this groove 90, there is mounted an O ring 91 which can be slidingly contacted with the inner surface of the drive portion cover 13. Here, normally, grease is filled into the cams 41 and 51 of the drive shaft 4 and hammer 5. That is, the present structure can prevent the grease from flowing out from between the outer peripheral portion of the adjust screw 77 and the inner surface of the drive portion cover 13, which in turn can prevent the seizure of the cam mechanism as well as can prevent the main body from being smeared with the grease.

The other structure is composed of a shaft 37 which is extended from the rear end of the switching pin 35 in the axial direction thereof. The shaft 37, which is loosely rotatably inserted into a hole formed in the center shaft of the sun gear 20 mounted on the output shaft of the motor 2, is used to center the switching pin 35 holding the connecting member 36, that is, center the drive carrier 24 to which the switching pin 35 is fixed. In case where the drive carrier 24 is centered, in a structure in which, by moving the drive carrier 24, the engagement of the connecting member 36 is achieved and the sun gear 27 disposed on the drive carrier 24 is meshingly engaged with the torque clutch 7 or the planetary gear 29 of the speed change means 8, these engaging operations can be executed smoothly, which allows smooth switching between the impact operation and drill or driver operation; and, depending on the kinds of operations, the impact operation can be switched over to the drill or driver operation while the impact operation is being executed, and vice versa.

As has been described heretofore, according to the invention, in an impact rotary tool including switching means capable of disabling an anvil, which is supported rotatable with respect to a drive shaft, from rotating with respect to the drive shaft, in both of the drive shaft and the anvil supported rotatable with respect to a drive shaft, there are formed engagement portions respectively engageable with a connecting member which can be operated in linking with the operation of an operation portion structured so as to be operated and input from outside, and the present connecting member is used as the switching means. According to this structure, without an operator carrying a connecting member which is produced separately, by operating the external operation inputting operation portion, the connecting member changes the states of the drive shaft and anvil on their relative rotation to thereby be able to switch the impact operation and drill operation over to each other. Also, as the present impact rotary tool does not include any factor that can lower the transmission efficiency, both of the impact operation and drill operation can be executed properly.

In this case, the switching member can be made compact, provided that the engagement portions of the drive shaft and anvil are situated on the same axis and also that the connecting member can be switched between two kinds of states, that is, a state in which it is engaged with both of the engagement portions of the drive shaft and anvil and a state in which it is not engaged with at least one of the engagement portions.

Also, in case where an intermediate transmission member interposed between the motor and drive shaft is supported so as to be movable in the axial direction thereof, and the operation member and connecting member are connected to the intermediate transmission member which is rotationally connected to the drive shaft through key connection, not only there is eliminated the need to position the operation member and connecting member at the same position but also there is eliminated the need for provision of an exclusively designed connecting member for connecting the operation member to the connecting member, thereby being able to reduce the number of parts used. Especially, in case where the intermediate transmission member is connected to the connecting member by an axially movable switching pin which extends through the drive shaft in the axial direction thereof and is free to move with respect to the drive shaft in the axial direction thereof, there can be obtained a special advantage that the impact rotary tool can be made compact.

In case where the connecting member is formed such that it can be freely rotated with respect to the switching pin and is prevented against rotation in the axial direction thereof, even in a structure in which the intermediate member and drive shaft are not the same in the rotation number, there is no possibility that there can occur any trouble.

Also, in case where the switching pin includes a shaft which is supported at the axis position thereof by a member fixed to the motor, centering of the switching pin and intermediate transmission member is possible, which makes it possible to execute the switching operation more smoothly.

In case where there is disposed a torque clutch in the power transmission route extending from a motor for driving to an output shaft, control of a tightening torque by the torque clutch is also possible.

In case where not only the present torque clutch includes an adjust screw which is supported so as to be threadedly movable back and forth and is capable of setting a sliding-start torque, but also the adjust screw can be engaged with a drive portion cover disposed freely rotatable around its own axis with respect to a housing in such a manner that the adjust screw can be slided freely in the axial direction thereof, an operation to set the sliding-start torque can be facilitated as well as there is eliminated the need for separate provision of an operation member for setting of the operation.

Also, in case where the adjust screw includes on the outer periphery thereof a seal member which can be slidingly contacted with the drive portion cover or the inner surface of the housing, grease filled into the cam portions of the drive shaft and harmer can be prevented from flowing out therefrom as well as the seizure of the cam mechanism and the dirty main body caused by the grease can be prevented.

In case where there is disposed speed change means in a power transmission route extending from a motor for driving to an output shaft, due to change of the speed of the rotation transmission, there can be obtained operations having different rotation numbers which correspond to the contents of operations.

In case the present speed change means is capable of changing the speed in linking with the switching means, in the impact operation and drilling operation, the drive shaft can be rotated in their preferred rotation numbers and, when the drive shaft and anvil are connected to each other by the connecting member in such a manner that they cannot be rotated with respect to each other, in case where the speed change is executed prior to such connection, a positive switching operation can be achieved.

Alternatively, in the power transmission route extending from the motor for driving to the output shaft, there may be disposed not only a torque clutch capable of switching its operation in linking with the operation of the switching means but also speed change means. In this structure, preferably, in case where, when the anvil is held so as to be rotatable with respect to the drive shaft, the torque clutch may be removed from the power transmission route and the change speed means may provide a small speed change ratio and, when the anvil is held so as to be disabled from rotating with respect to the drive shaft, the torque clutch may be disposed in the power transmission route and the change speed means may provide a large speed change ratio in this case, the impact operation and drill operation are able to obtain torque clutch operations and reduction ratios which correspond to the contents of the operations, thereby being able to supply an impact rotary tool which can provide a good operation efficiency.

Also, in case where the connecting member is structured such that it connects the drive shaft and anvil to each other only at a position where the hammer does not run onto the anvil, it is possible to obtain an impact rotary tool which can prevent the load of a spring for energizing the hammer from becoming a load in the drill operation. Further, in case where the connecting member is structured such that it connects the drive shaft and anvil to each other in a state in which the hammer is in contact with the anvil in a rotation transmittable manner, there can be obtained an impact rotary tool which does not require a wasteful operation for positioning.

In case where the operation allowable clearance of the connecting member in the axial direction thereof in a state in which the drive shaft and anvil are separated from each other is set larger than the thrust play of the drive shaft, there is no possibility that an unreasonable load can be applied to the connecting member, thereby being able to supply an impact rotary tool which has a long life.

In addition, in case where the operation portion and connecting member are connected to each other through an elastic member, not only there can be obtained a switching operation which can be executed smoothly with a good operation efficiency.

What is claimed is:

1. An impact rotary tool, comprising:

an impact mechanism including a spring for energizing a hammer connected through a cam to a drive shaft toward an anvil disposed uniformly on an output shaft, said impact mechanism being structured such that said anvil is engaged with said hammer in an impact manner using said cam and said spring to thereby generate a rotation force; and, switching means for switching said anvil supported relatively rotatable with respect to said drive shaft over to a state such that said anvil is disabled from proportionally rotating with respect to said drive shaft;

an engaging portion provided with said drive shaft and said anvil supported relatively rotatable with respect to said drive shaft, respectively, each of said engaging portions engaged with a connecting member, wherein said connecting member is operated in linking with the operation of and operation portion operated from an external side, said connecting member serves as said switching means.

2. An impact rotary tool as set forth in claim 1, wherein said engagement portion of said drive shaft and said engagement portion of said anvil are concentrically arranged, and said connecting member can be switched between a state that said connecting member is engaged with both of said two engagement portions of said drive shaft and said anvil at the same time and a state that said connecting member is not engaged with at least one of said engagement portions.

3. An impact rotary tool as set forth in claim 1, further comprising:

an intermediate transmission member interposed between a motor and said drive shaft, and supported in such a manner that said intermediate transmission member is freely moved in the axial direction thereof; and an operation member and said connecting member connected to said intermediate transmission member, said intermediate transmission member being rotationally connected to said drive shaft through key connection.

4. A impact rotary tool as set forth in claim 3, further comprising:

a switching pin extending through said drive shaft in the axial direction thereof and being freely moved in the axial direction thereof with respect to said drive shaft, said switching pin connecting said intermediate transmission member and said connecting member each other.

5. An impact rotary tool as set forth in claim 4, wherein said connecting member is connected in such a manner that said connecting member is freely rotated with respect to said switching pin and is disabled from moving in the axial direction thereof.

6. An impact rotary tool as set forth in claim 4, wherein said switching pin includes a shaft which is supported at the axis position thereof by a member fixed to said motor.

7. An impact rotary tool as set forth in claim 1, further comprising:

a torque clutch disposed in a power transmission route extending from a motor for driving to an output shaft.

8. An impact rotary tool as set forth in claim 7, wherein said torque clutch includes an adjust screw supported threadedly movable back and forth for setting a sliding-start torquer and said adjust screw engaged in an axially slidable manner with a drive portion cover disposed so as to be freely rotatable around its own axis with respect to a housing and the axial movement of said adjust screw is achieved by the rotational operation of said drive portion cover.

9. An impact rotary tool as set forth in claim 8, wherein said adjust screw includes a seal member on the outer periphery thereof, said seal member is slidingly contacted with one of said drive portion cover and the inner surface of said housing.

10. An impact rotary tool as set forth in claim 1, further comprising:

a speed change mechanism disposed in a power transmission route extending from a motor for driving to an output shaft.

11. An impact rotary tool as set forth in claim 10, wherein said speed change means changes the speed of power transmission in linking with said switching means and, when said drive shaft and said anvil are connected by said connecting member in such a manner that said shaft and said anvil are disabled from rotating with respect to each other, said speed change mechanism executes said speed change prior to said connection between said drive shaft and said anvil.

12. An impact rotary tool as set forth in claim 1, further comprising:

a torque clutch capable of switching its own operation in linking with the operation of said switching operation but also speed change mechanism disposed in a power transmission route extending from a motor for driving to an output shaft, wherein, when said anvil is held so as to be rotatable with respect to said drive shaft, said torque clutch is removed from said power transmission route and said speed change mechanism provides a small speed change ratio, and, when said anvil is held so as to be disabled from rotating with respect to said drive shaft, said torque clutch is disposed in said power transmission route and said speed change mechanism provides a large speed change ratio.

13. An impact rotary tool as set forth in claim 1, wherein said connecting member connects said drive shaft and said anvil to each other only at the position where said hammer does not run onto said anvil.

14. An impact rotary tool as set forth in claim 1, wherein said connecting member connects said drive shaft and said anvil to each other in a state where said hammer is in contact with said anvil in a rotation transmission allowable manner.

15. An impact rotary tool as set forth in claim 1, wherein the operation allowable clearance of said connecting member in the axial direction thereof is set larger than the thrust play of said drive shaft in a state where said drive shaft and said anvil are separated from each other.

16. An impact rotary tool as set forth in claim 1, wherein said operation portion and said connecting member are connected to each other through an elastic member.

17. An impact rotary tool comprising:

an output shaft having an anvil at an end portion thereof;

a hammer having a projecting portion applying an impact force to said anvil under a predetermined condition;

a driving shaft connected to said hammer through a cam mechanism; and a changeover mechanism for changing the connection between said driving shaft and said output shaft, said mechanism being arranged along with a common axis defined by said driving shaft and said output shaft, wherein said changeover mechanism includes a connecting member accommodated into said driving shaft in a first condition, and connecting said driving shaft and the output shaft in a second condition.

18. An impact rotary tool as claimed in claim 17, wherein said changeover mechanism includes a changeover pin arranged along the axis of the driving shaft, said changeover pin has a constricted portion at an end portion thereof, and said connecting member rotates freely with said constricted portion.

19. An impact rotary tool as claimed in claim 18, wherein said changeover mechanism includes an operation mechanism for moving said changeover pin along with said common axis.

* * * * *